US007226231B2

(12) United States Patent
Py et al.

(10) Patent No.: US 7,226,231 B2
(45) Date of Patent: Jun. 5, 2007

(54) PISTON-TYPE DISPENSER WITH ONE-WAY VALVE FOR STORING AND DISPENSING METERED AMOUNTS OF SUBSTANCES

(75) Inventors: Daniel Py, Stamford, CT (US); Julian V. Chan, Spring Valley, NY (US); Giovanni Rodriguez, Stamford, CT (US)

(73) Assignee: Medical Instill Technologies, Inc., New Milford, CT (US)

( * ) Notice: Subject to any disclaimer, the term of this patent is extended or adjusted under 35 U.S.C. 154(b) by 191 days.

(21) Appl. No.: 10/893,686

(22) Filed: Jul. 16, 2004

(65) Prior Publication Data

US 2005/0089358 A1 Apr. 28, 2005

Related U.S. Application Data

(60) Provisional application No. 60/488,355, filed on Jul. 17, 2003, provisional application No. 60/539,814, filed on Jan. 27, 2004.

(51) Int. Cl.

| | |
|---|---|
| ***B05C 11/00*** | (2006.01) |
| ***A46B 11/00*** | (2006.01) |
| ***B43K 5/06*** | (2006.01) |
| ***B43K 5/04*** | (2006.01) |

(52) U.S. Cl. ..... 401/266; 401/263; 401/11; 401/179; 401/152; 401/155

(58) Field of Classification Search ..... 401/152, 401/153, 155, 156, 176, 179, 186, 188 R, 401/263, 265, 266, 11; 222/386.5, 387
See application file for complete search history.

(56) References Cited

U.S. PATENT DOCUMENTS

| | | | |
|---|---|---|---|
| 1,471,091 | A | 10/1923 | Bessesen |
| 2,128,035 | A | 8/1938 | Boetel |
| 2,522,403 | A | 9/1950 | Ross |

(Continued)

FOREIGN PATENT DOCUMENTS

| | | | |
|---|---|---|---|
| EP | 0802827 | B1 | 8/1998 |

(Continued)

*Primary Examiner*—David J. Walczak
(74) *Attorney, Agent, or Firm*—McCarter & English, LLP

(57) ABSTRACT

A dispenser for dispensing a substance, such as a liquid lipstick or other product, has a body defining a variable-volume storage chamber for storing the product. A dispensing portion is connected with the body and defines a bore coupled in fluid communication with the storage chamber for receiving product therefrom, and an outlet aperture coupled in fluid communication with the bore. A piston is received within the bore, and a one-way valve is mounted on the dispensing portion for dispensing metered amounts of product therethrough. The one-way valve has an axially-extending valve seat, and an axially-extending visco-elastic valve cover seated on the valve seat and defining a normally-closed, axially-extending seam therebetween forming a fluid-tight seal between the valve cover and valve seat. The flexible valve cover is movable relative to the valve seat, and the seam is connectable in fluid communication with the outlet aperture to allow the passage of product through the seam and out of the dispenser. An actuator is drivingly connected to the piston for moving the piston within the bore and dispensing a predetermined amount of product within the bore through the outlet aperture.

49 Claims, 26 Drawing Sheets

U.S. PATENT DOCUMENTS

| | | | | |
|---|---|---|---|---|
| 2,648,334 | A | | 8/1953 | Brown et al. |
| 2,687,133 | A | | 8/1954 | Schwarz |
| 2,951,584 | A | | 9/1960 | Bauer |
| 3,123,661 | A | | 3/1964 | Roman |
| 3,353,718 | A | | 11/1967 | McLay |
| 3,356,093 | A | | 12/1967 | Monahon |
| 3,412,910 | A | | 11/1968 | Hahn |
| 3,648,903 | A | | 3/1972 | Marchant |
| 3,659,749 | A | | 5/1972 | Schwartz |
| 3,662,753 | A | | 5/1972 | Tassell |
| 3,669,323 | A | | 6/1972 | Harker et al. |
| 3,699,961 | A | | 10/1972 | Szpur |
| 3,756,729 | A | | 9/1973 | Tufts |
| 3,838,689 | A | | 10/1974 | Cohen |
| 3,921,333 | A | | 11/1975 | Clendinning et al. |
| 3,963,814 | A | | 6/1976 | Cospen et al. |
| 3,993,069 | A | | 11/1976 | Buckles et al. |
| 4,002,516 | A | | 1/1977 | Gaborieau et al. |
| 4,023,607 | A | | 5/1977 | Jensen et al. |
| 4,050,459 | A | | 9/1977 | Sanchez |
| 4,102,476 | A | | 7/1978 | Loeffler |
| 4,128,349 | A | * | 12/1978 | Del Bon ..... 401/151 |
| 4,141,474 | A | | 2/1979 | Nilson |
| 4,185,628 | A | | 1/1980 | Kopfer |
| 4,189,065 | A | | 2/1980 | Herold |
| 4,233,262 | A | | 11/1980 | Curto |
| 4,239,132 | A | | 12/1980 | Mueller et al. |
| 4,240,465 | A | | 12/1980 | Rader |
| 4,264,018 | A | | 4/1981 | Warren |
| 4,346,708 | A | | 8/1982 | LeVeen et al. |
| 4,367,739 | A | | 1/1983 | LeVeen et al. |
| 4,420,100 | A | | 12/1983 | Mueller |
| 4,458,830 | A | | 7/1984 | Werding |
| 4,475,905 | A | | 10/1984 | Himmelstrup |
| 4,479,578 | A | | 10/1984 | Brignola et al. |
| 4,479,989 | A | | 10/1984 | Mahal |
| 4,482,585 | A | | 11/1984 | Ohodaira et al. |
| 4,493,348 | A | | 1/1985 | Lemmons |
| 4,501,781 | A | | 2/1985 | Kushida et al. |
| 4,513,891 | A | | 4/1985 | Hain et al. |
| 4,526,294 | A | | 7/1985 | Hirschmann et al. |
| 4,578,295 | A | | 3/1986 | Jabarin |
| 4,579,757 | A | | 4/1986 | Su et al. |
| 4,603,066 | A | | 7/1986 | Jabarin |
| 4,624,594 | A | | 11/1986 | Sasaki et al. |
| 4,636,412 | A | | 1/1987 | Field |
| 4,643,723 | A | | 2/1987 | Smit |
| 4,699,300 | A | | 10/1987 | Blake |
| 4,700,838 | A | | 10/1987 | Falciani et al. |
| 4,704,510 | A | | 11/1987 | Matsui |
| 4,722,459 | A | * | 2/1988 | Goncalves ..... 222/135 |
| 4,737,148 | A | | 4/1988 | Blake |
| 4,739,906 | A | | 4/1988 | LoTurco |
| 4,776,717 | A | | 10/1988 | Iizuka et al. |
| 4,784,652 | A | | 11/1988 | Wikström |
| 4,842,165 | A | | 6/1989 | Van Coney |
| 4,854,481 | A | | 8/1989 | Bohl et al. |
| 4,854,486 | A | | 8/1989 | Daley et al. |
| 4,859,513 | A | | 8/1989 | Gibbons et al. |
| 4,865,591 | A | | 9/1989 | Sams |
| 4,880,675 | A | | 11/1989 | Mehta |
| 4,895,279 | A | | 1/1990 | Schultz |
| 4,903,741 | A | | 2/1990 | Ibanez |
| 4,910,147 | A | | 3/1990 | Bacehowski et al. |
| 4,921,733 | A | | 5/1990 | Gibbons et al. |
| 4,923,480 | A | | 5/1990 | Monestere |
| 4,936,833 | A | | 6/1990 | Sams |
| 4,949,877 | A | | 8/1990 | Hanna et al. |
| 4,962,868 | A | | 10/1990 | Borchard |
| 4,973,318 | A | | 11/1990 | Holm et al. |
| 4,978,036 | A | | 12/1990 | Burd |
| 4,981,479 | A | | 1/1991 | Py |
| 5,033,647 | A | | 7/1991 | Smith et al. |
| 5,083,416 | A | | 1/1992 | Schneider et al. |
| 5,102,705 | A | | 4/1992 | Yammoto et al. |
| 5,108,007 | A | | 4/1992 | Smith et al. |
| 5,143,236 | A | | 9/1992 | Gueret |
| 5,178,300 | A | | 1/1993 | Haviv et al. |
| 5,197,638 | A | | 3/1993 | Wood |
| 5,226,568 | A | | 7/1993 | Newton et al. |
| 5,226,895 | A | | 7/1993 | Harris |
| 5,238,153 | A | | 8/1993 | Castillo et al. |
| 5,244,465 | A | | 9/1993 | Michel |
| 5,253,785 | A | | 10/1993 | Haber et al. |
| 5,257,696 | A | | 11/1993 | Greene |
| 5,263,946 | A | | 11/1993 | Klug |
| 5,267,986 | A | | 12/1993 | Py |
| 5,277,342 | A | * | 1/1994 | Dickau et al. ..... 222/387 |
| 5,290,260 | A | | 3/1994 | Stines |
| 5,318,204 | A | | 6/1994 | Davis et al. |
| 5,320,256 | A | | 6/1994 | Wood |
| 5,320,845 | A | | 6/1994 | Py |
| 5,332,121 | A | | 7/1994 | Schmidt et al. |
| 5,339,972 | A | | 8/1994 | Crosnier et al. |
| 5,360,145 | A | | 11/1994 | Gueret |
| 5,366,108 | A | | 11/1994 | Darling |
| 5,401,259 | A | | 3/1995 | Py |
| 5,416,303 | A | | 5/1995 | Grooms et al. |
| 5,419,465 | A | | 5/1995 | Schroeder |
| 5,425,465 | A | | 6/1995 | Healy |
| 5,429,254 | A | | 7/1995 | Christine |
| 5,489,026 | A | | 2/1996 | D'Aloia |
| 5,489,027 | A | | 2/1996 | Goerigk |
| RE35,187 | E | | 3/1996 | Gortz |
| 5,497,910 | A | | 3/1996 | Meadows et al. |
| D368,774 | S | | 4/1996 | Py |
| 5,545,147 | A | | 8/1996 | Harris |
| 5,556,678 | A | | 9/1996 | Jupin et al. |
| D374,719 | S | | 10/1996 | Py |
| 5,562,960 | A | | 10/1996 | Sugiura et al. |
| 5,564,596 | A | | 10/1996 | Meadows et al. |
| 5,565,160 | A | | 10/1996 | Makuuchi et al. |
| 5,582,330 | A | | 12/1996 | Iba |
| 5,582,598 | A | | 12/1996 | Chanoch |
| 5,591,136 | A | | 1/1997 | Gabriel |
| 5,609,273 | A | | 3/1997 | Firestone et al. |
| 5,613,957 | A | | 3/1997 | Py |
| 5,615,795 | A | | 4/1997 | Tipps |
| 5,630,800 | A | | 5/1997 | Blank et al. |
| 5,636,930 | A | | 6/1997 | Holloway |
| 5,641,004 | A | | 6/1997 | Py |
| 5,664,704 | A | | 9/1997 | Meadows et al. |
| 5,676,267 | A | | 10/1997 | Slat et al. |
| 5,685,869 | A | | 11/1997 | Py |
| 5,687,882 | A | | 11/1997 | Mueller |
| 5,692,651 | A | | 12/1997 | Fuchs |
| 5,702,019 | A | | 12/1997 | Grimard |
| 5,718,334 | A | | 2/1998 | Demel |
| 5,727,892 | A | | 3/1998 | Baudin |
| 5,728,075 | A | | 3/1998 | Levander |
| 5,730,322 | A | | 3/1998 | Iba et al. |
| 5,738,067 | A | | 4/1998 | Landwehr |
| 5,743,441 | A | | 4/1998 | Baudin et al. |
| 5,743,889 | A | | 4/1998 | Sams |
| 5,746,728 | A | | 5/1998 | Py |
| 5,755,269 | A | | 5/1998 | Venooker et al. |
| 5,759,218 | A | | 6/1998 | Martin et al. |
| 5,772,347 | A | | 6/1998 | Gueret |
| 5,780,130 | A | | 7/1998 | Hansen et al. |
| 5,785,683 | A | | 7/1998 | Szapiro et al. |
| 5,799,837 | A | | 9/1998 | Firestone et al. |
| 5,803,311 | A | | 9/1998 | Fuchs |
| 5,804,236 | A | | 9/1998 | Frisk |
| 5,816,772 | A | | 10/1998 | Py |

5,823,397 A 10/1998 Gil
5,829,901 A 11/1998 Brown et al.
5,855,302 A 1/1999 Fisscher
5,860,755 A 1/1999 Bunk
5,875,931 A 3/1999 Py
5,876,372 A 3/1999 Grabenkort et al.
5,879,095 A 3/1999 Gueret
5,879,336 A 3/1999 Brinon
5,899,624 A 5/1999 Thompson
5,921,989 A 7/1999 Deacon et al.
5,931,386 A 8/1999 Jouillat
5,934,500 A 8/1999 Cogger et al.
5,944,702 A 8/1999 Py
RE36,410 E 11/1999 Meshberg
5,983,905 A 11/1999 Patching
6,004,298 A 12/1999 Levander
6,032,101 A 2/2000 Freedman et al.
6,033,384 A 3/2000 Py
6,050,444 A 4/2000 Sugg
6,053,370 A 4/2000 Ludbrook et al.
6,053,893 A 4/2000 Bucher
6,062,430 A 5/2000 Fuchs
6,062,437 A 5/2000 Mascitelli
6,083,201 A 7/2000 Skinkle
6,083,450 A 7/2000 Safian
6,145,707 A 11/2000 Baudin
6,170,705 B1 1/2001 Schneider et al.
RE37,047 E 2/2001 Py
6,186,686 B1 2/2001 Neuner et al.
6,193,698 B1 2/2001 Kirchhofer et al.
6,200,047 B1 3/2001 Holloway
6,202,901 B1 3/2001 Gerber et al.
6,234,363 B1 5/2001 Stradella
6,254,579 B1 7/2001 Cogger et al.
6,267,768 B1 7/2001 Deacon et al.
6,280,421 B1 8/2001 Kirchhofer et al.
6,283,976 B1 9/2001 Portney
6,290,679 B1 9/2001 Hostettler et al.
6,301,767 B1 10/2001 Granger et al.
6,306,423 B1 10/2001 Donovan et al.
6,312,708 B1 11/2001 Donovan
6,325,253 B1 12/2001 Robinson
6,338,442 B1 1/2002 De Laforcade
6,343,713 B1 2/2002 Abplanalp
6,351,924 B1 3/2002 Gustafsson et al.
6,357,945 B1 3/2002 Losier et al.
6,371,129 B1 4/2002 Le Bras-Brown et al.
6,383,167 B2 5/2002 Kirchhofer et al.
6,383,509 B1 5/2002 Donovan et al.
6,386,395 B1 5/2002 Lunghetti
6,419,412 B1 7/2002 Ostrowski et al.
6,428,545 B2 8/2002 Portney
6,446,844 B1 9/2002 Gross
6,450,994 B1 9/2002 Boyles et al.
6,471,095 B1 * 10/2002 Cann ..... 222/190
6,485,470 B2 11/2002 Hostettler et al.
6,502,725 B1 1/2003 Alexander
6,533,482 B1 3/2003 Byun
6,581,805 B2 * 6/2003 Conboy et al. ..... 222/340
6,604,561 B2 8/2003 Py
6,662,977 B2 12/2003 Gerber et al.
6,761,286 B2 7/2004 Py et al.
2001/0009990 A1 7/2001 Hostettler et al.
2002/0017294 A1 2/2002 Py
2002/0071708 A1 6/2002 Fontanet et al.
2002/0074362 A1 6/2002 Py et al.
2003/0089743 A1 5/2003 Py et al.
2004/0112925 A1 6/2004 Py et al.

FOREIGN PATENT DOCUMENTS

EP 0649795 B1 6/1999
EP 0673852 B1 2/2000

* cited by examiner

PISTON-TYPE DISPENSER WITH ONE-WAY VALVE FOR STORING AND DISPENSING METERED AMOUNTS OF SUBSTANCES

CROSS-REFERENCE TO RELATED APPLICATIONS

This patent application claims priority to U.S. provisional application Ser. No. 60/488,355, filed Jul. 17, 2003, entitled "Piston-Type Dispenser with One-Way Valve for Storing and Dispensing Metered Amounts of Substances, and Pivoting Cover for Covering Dispensing Portion Thereof", and to U.S. provisional application Ser. No. 60/539,814, filed Jan. 27, 2004, entitled "Piston-Type Dispenser with One-Way Valve for Storing and Dispensing Metered Amounts of Substances", each of which is hereby expressly incorporated by reference as part of the present disclosure.

FIELD OF THE INVENTION

The present invention relates to dispensers for containing and dispensing fluids and other substances, such as cosmetic products, and more particularly, to dispensers for holding multiple doses of such fluids and other substances, and that include one-way valves for hermetically sealing the substances within the dispensers, actuators for actuating pumps within the dispensers and dispensing metered doses of substances through the one-way valves, and in some embodiments, covers that are movably mounted on the dispensers for selectively covering and accessing the dispensing portions of the dispensers.

BACKGROUND INFORMATION

Prior art dispensers for storing and dispensing multiple doses of fluids, such as cosmetic dispensers for dispensing, for example, liquid lipstick, typically do not store the liquid lipstick or other product in a hermetically sealed storage chamber. In addition, such dispensers may be exposed to, or are applied to a user's lips or other facial surfaces that may contain dirt, germs, bacteria and/or other unwanted contaminants. Such contaminants can penetrate through the dispensing openings in the dispensers and, in turn, contaminate the bulk of the product, such as a liquid lipstick, stored within the dispensers. As a result, the contaminants can be passed from one user to another or otherwise cause unhealthy conditions with further usage of the dispensers. Further, because the products stored within the dispensers are exposed to air, the products can degrade or spoil, and/or require preservatives to prevent such degradation and/or spoilage from occurring. In some circumstances, preservatives can cause allergic and/or other undesirable or negative reactions, such as unwanted dermatological reactions.

It is an object of the present invention to overcome one or more of the above-described drawbacks and/or disadvantages of the prior art.

SUMMARY OF THE INVENTION

In accordance with one aspect, the present invention is directed to a dispenser for dispensing a substance comprises a body defining a variable-volume storage chamber for storing the substance, such as a liquid lipstick, concealer, or other cosmetic or cosmeceutical product. A dispensing portion of the dispenser is connected with the body and defines a compression chamber or bore coupled in fluid communication with the storage chamber for receiving substance therefrom. A piston is received within the bore and an outlet aperture is coupled in fluid communication with the bore. A one-way valve including an axially-extending valve seat and an axially-extending flexible valve cover is seated on the valve seat and defines a normally-closed, axially-extending seam between the valve cover and valve seat forming a fluid-tight seal therebetween. The flexible valve cover is movable relative to the valve seat, and the seam is connectable in fluid communication with the outlet aperture to allow the passage of a predetermined amount of substance pumped by the piston through the seam and out of the dispenser. An actuator is drivingly connected to at least one of the piston and the bore for moving at least one of the piston and the bore relative to the other and dispensing a predetermined amount of substance within the bore through the outlet aperture.

In some embodiments of the present invention, at least one cover extends adjacent to and covers the dispensing portion, and is movably mounted with respect to the dispensing portion between a closed position covering the dispensing portion and an open position exposing the dispensing portion.

In some embodiments of the present invention, the flexible valve cover is responsive to a flow of substance in the outlet aperture exceeding a valve opening pressure to move between (i) a normally-closed condition, and (ii) an open condition wherein portions of the valve cover axially spaced relative to each other substantially sequentially move substantially radially relative to the valve seat to allow the passage substance through the seam and out of the dispenser.

Also in a currently preferred embodiment of the present invention, the substance is a cosmetic, such as a liquid lipstick or a concealer, and the dispensing portion includes an applicator surface defining a contour substantially conforming to a facial contour for facilitating application of the cosmetic thereto.

In some embodiments of the present invention, the dispenser comprises a flexible bladder mounted within the body and defining the storage chamber between the bladder and body. The dispenser also includes a spring for biasing the piston and, preferably, the spring is formed integral with the bladder. In one embodiment of the present invention, the spring is formed by a substantially dome-shaped portion of the bladder.

In one such embodiment of the present invention, the bladder defines a first axially-extending, annular surface, and the body defines a second axially-extending, annular surface facing the first surface of the bladder and forming the storage chamber therebetween. The first surface of the bladder is movable radially inwardly and away from the second surface of the body to expand the storage chamber and receive substance therein. In addition, the first surface of the bladder is movable radially outwardly toward the second surface of the body upon dispensing substance therefrom. Also in this embodiment, a cap is coupled to the body and defines an aperture therethrough. The piston is received through the aperture and at least one of the piston and cap is movable relative to the other between a first position with the piston spaced away from the outlet aperture and defining a compression chamber therebetween, and a second position with the piston located adjacent to the outlet aperture for dispensing a predetermined amount of substance within the compression chamber through the outlet aperture.

In some embodiments of the present invention, the dispenser further comprises a substantially annular piston slidably received within the body and forming a substantially fluid-tight seal therebetween. The variable-volume storage chamber is formed between the substantially annular piston and the other piston, and the substantially annular piston is movable toward the other piston upon dispensing a dosage from the storage chamber to reduce the volume of the storage chamber in an amount approximately equal to the volume of the dose dispensed.

In some embodiments of the present invention, the dispenser further comprises a filling tube received within the body, and a second one-way valve coupled in fluid communication between the filling tube and the variable volume storage chamber. The second one-way valve preferably includes an axially-extending valve seat and an axially-extending flexible valve cover seated on the valve seat and defining a normally-closed, axially-extending seam therebetween forming a fluid-tight seal between the valve cover and valve seat. The flexible valve cover is movable relative to the valve seat, and the seam is connectable in fluid communication with variable-volume storage chamber to permit the passage of substance through the seam and into the storage chamber.

In accordance with another aspect, the present invention is directed to a method for storing and dispensing a substance with a dispenser. The dispenser includes a variable-volume storage chamber, a dispensing valve including an annular, axially-extending valve seat, and an annular, axially-extending flexible valve cover overlying the valve seat and forming an axially-extending valve seam therebetween, and a pump coupled in fluid communication between the variable-volume storage chamber and the valve seam. The method comprises the following steps:

(i) storing substance in the variable-volume storage chamber;

(ii) normally sealing the dispensing valve along the annular, axially-extending valve seam and preventing both the dispensing of substance below a threshold pressure through the valve seam, and external contamination of the substance in the variable-volume storage chamber through the valve seam;

(iii) manually actuating the pump to pressurize a metered dose of substance to a pressure greater than the threshold pressure and, in turn, substantially sequentially opening the valve seam in an axial direction thereof to allow the passage of substance at a pressure greater than the threshold pressure through the valve seam and out of the dispenser; and (iv) decreasing the volume of the variable-volume storage chamber in an amount approximately equal to the volume of the dosage of substance dispensed.

In accordance with another aspect, the method further comprises the step of providing a filling tube mounted within a body portion of the dispenser, and a second one-way valve coupled in fluid communication between the filling tube and variable-volume storage chamber. The second one-way valve includes an axially-extending valve seat and an axially-extending flexible valve cover seated on the valve seat and defining a normally-closed, axially-extending seam therebetween forming a fluid-tight seal between the valve cover and valve seat. In accordance with this aspect, the method further comprises the steps of (i) inserting a filling member into the filling tube, (ii) pumping substance through the filling tube and into the seam of the second one-way valve at sufficient pressure to substantially radially move the flexible valve cover relative to the valve seat and, in turn, introduce the substance through the seam and into the variable-volume storage chamber, (iii) terminating pumping substance into the seam, (iv) allowing the valve cover to return to its normally-closed position, and (v) hermetically sealing the substance within the variable-volume storage chamber One advantage of the present invention is that the dispenser can store multiple doses of substances, such as liquid lipsticks, concealers, or other cosmetic or cosmeceutical products, in a hermetically sealed, sterile condition throughout the shelf life and usage of the dispenser. Further, currently preferred embodiments of the dispenser can provide metered doses of the liquid lipstick, concealer, or other substance with a simple, one-handed actuation motion.

Other objects and advantages of the present invention will become apparent in view of the following detailed description of the currently preferred embodiments and the accompanying drawings.

DETAILED DESCRIPTION OF THE PREFERRED EMBODIMENTS

Figure 1:
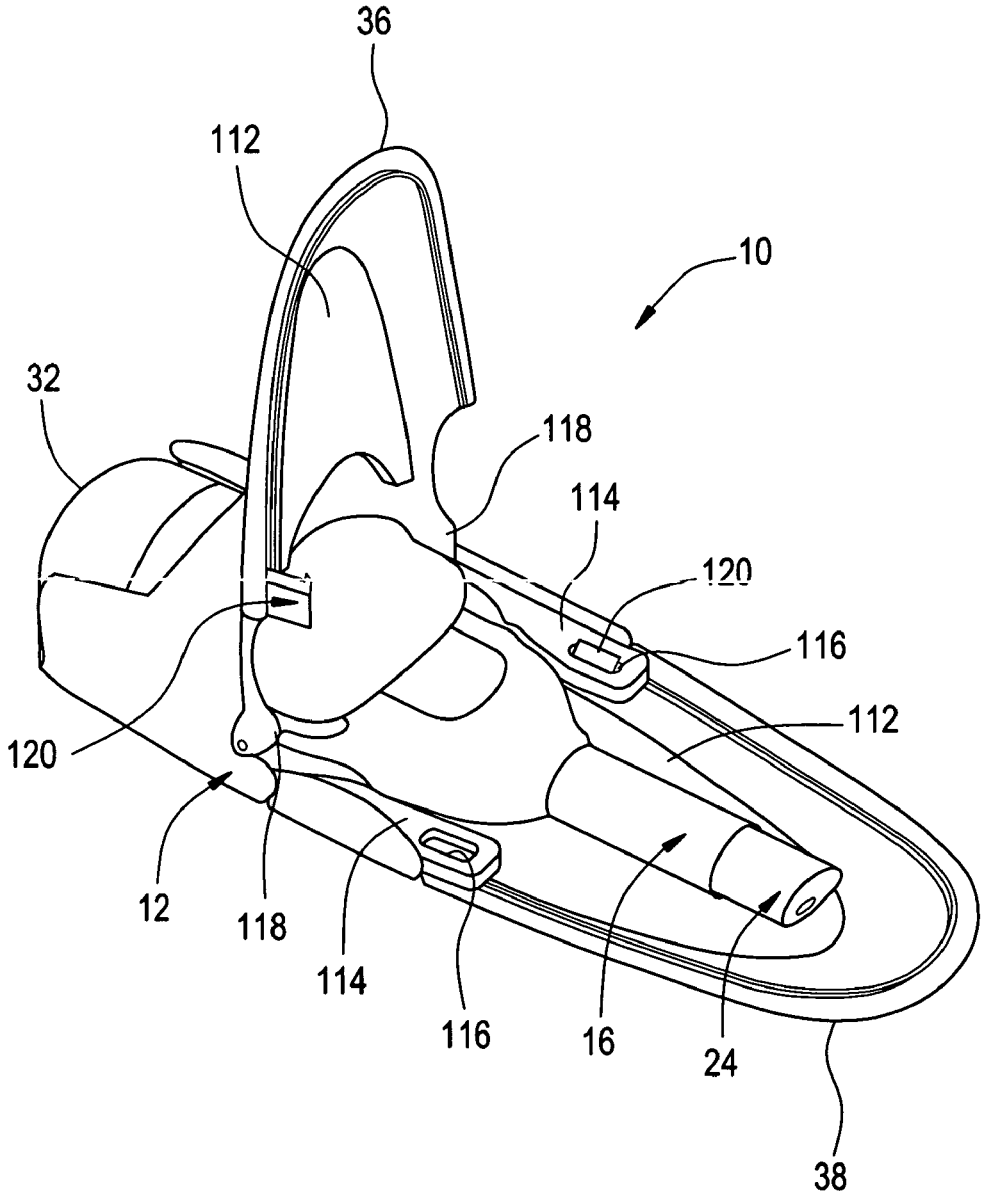
FIG. 1 is a top perspective view of a dispenser embodying the present invention showing the upper cover in an open position and the lower cover in a closed position.
Figure 2:
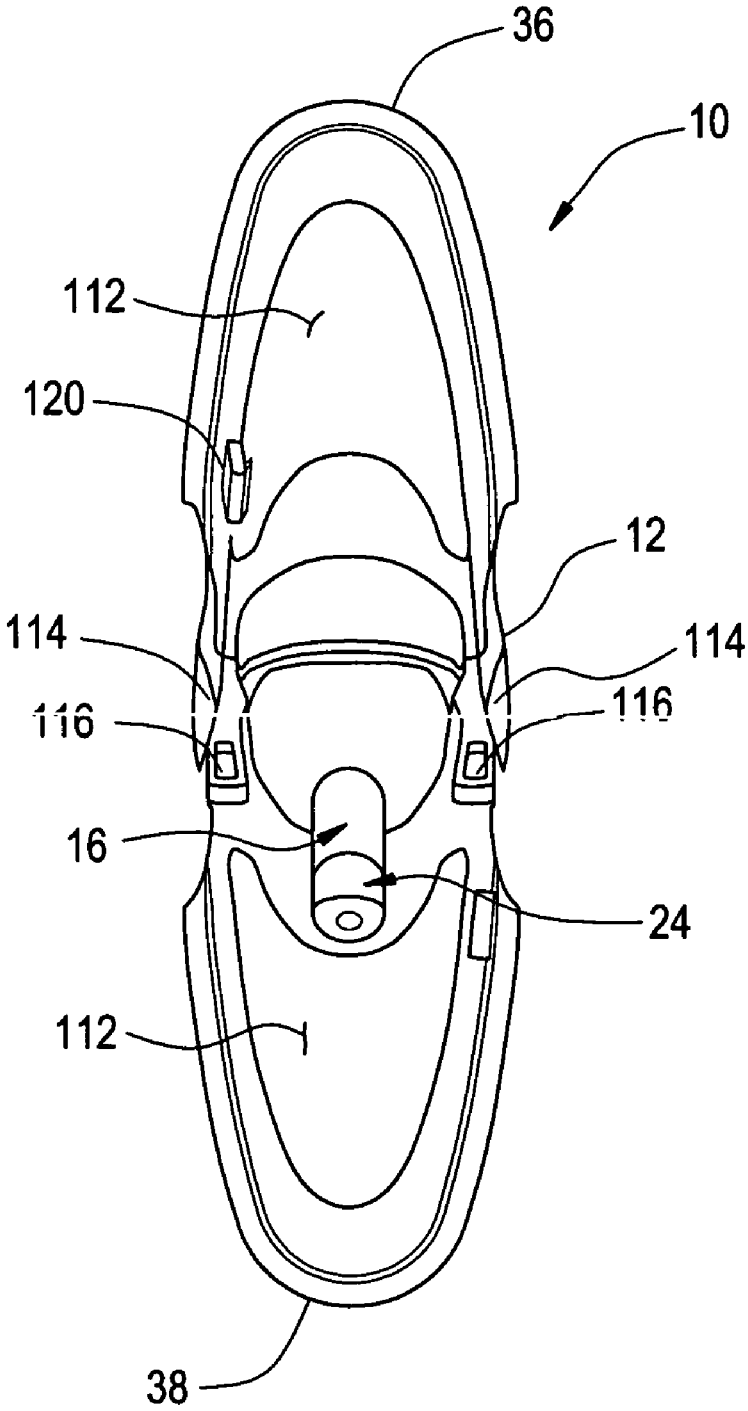
FIG. 2 is a front perspective view of the dispenser of FIG. 1 with both upper and lower covers open.
Figure 3:
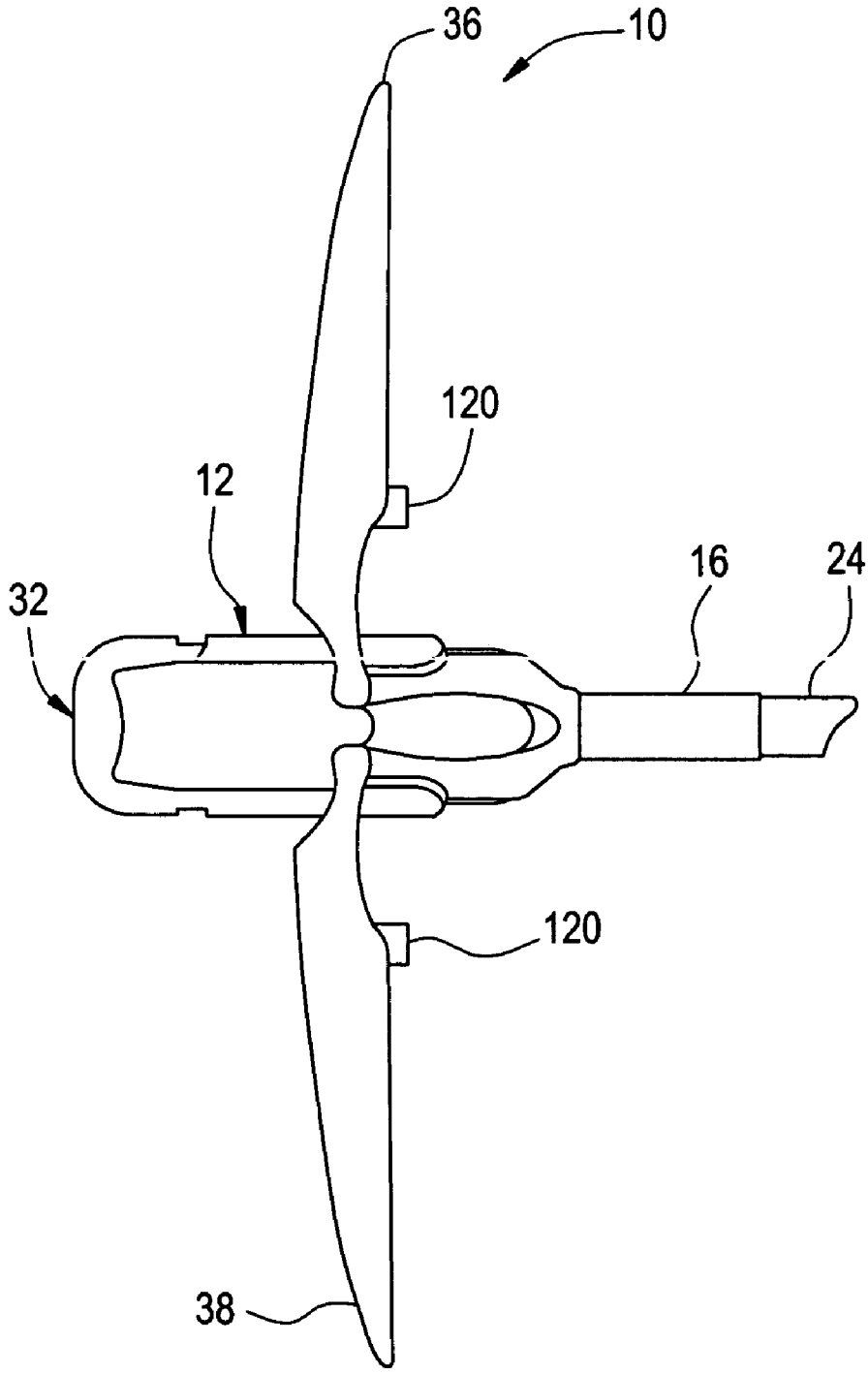
FIG. 3 is a side plan view of the dispenser of FIG. 1 with the upper and lower covers open.
Figure 4:
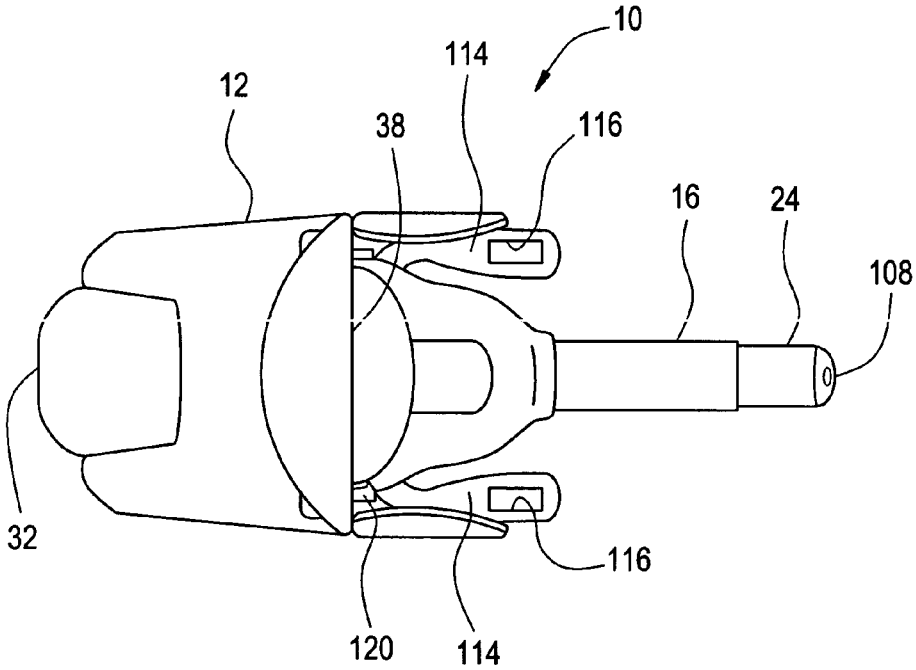
FIG. 4 is a bottom plan view of the dispenser of FIG. 1 with both covers open.
Figure 5:
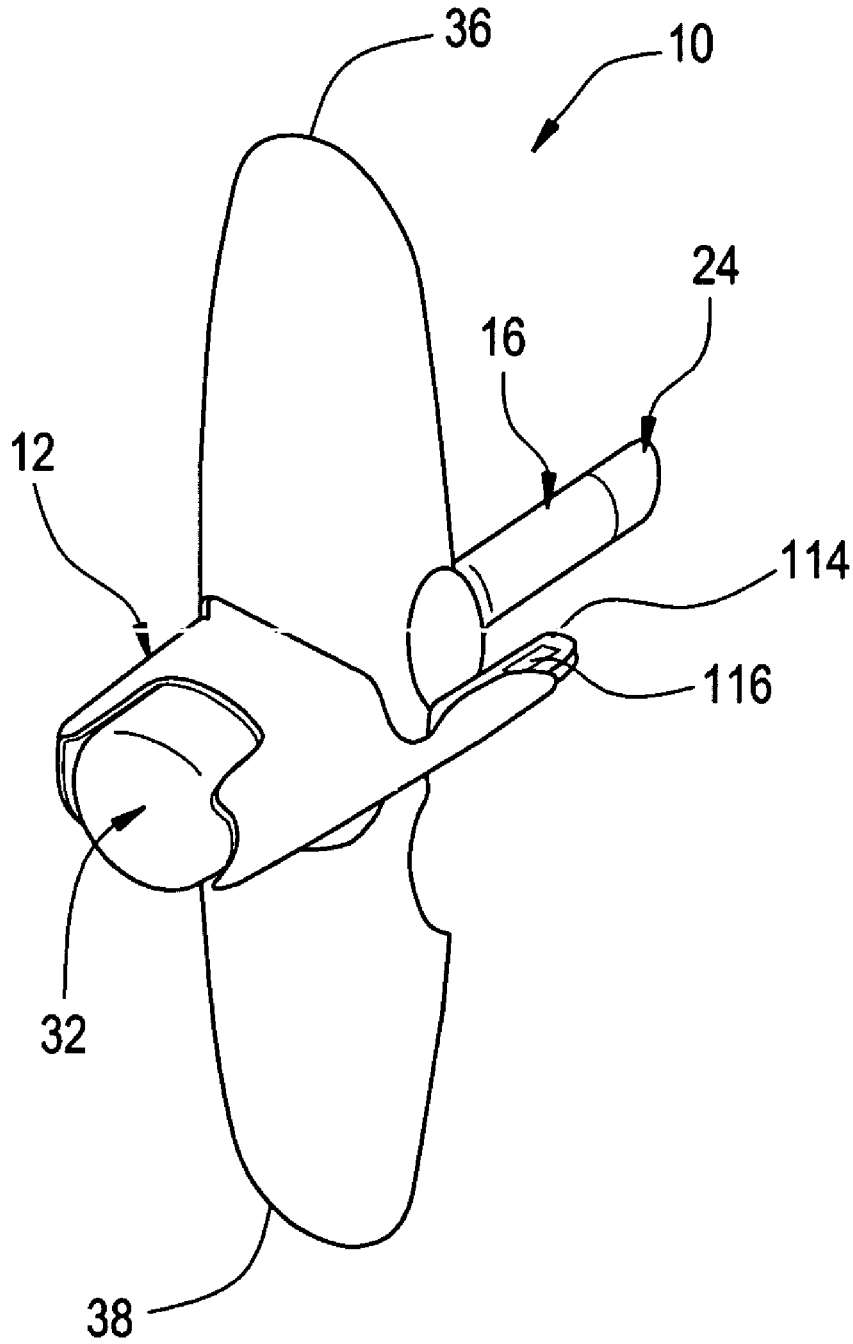
FIG. 5 is a rear perspective view of the dispenser of FIG. 1 with both covers open.

In FIG. 1, a dispenser embodying the present invention is indicated generally by the reference numeral 10. The dispenser 10 is particularly suitable for dispensing metered amounts of fluids and other substances, such as cosmetic and cosmeceutical products, including, for example, liquid lipsticks and concealers. However, as may be recognized by those of ordinary skill in the pertinent art based on the teachings herein, the dispenser 10 may be adapted to dispense any of numerous different fluids or other substances that are currently known, or later become known. As shown typically in FIG. 6, the dispenser 10 includes a body 12 defining a variable-volume storage chamber 14 for storing the substance, such as a liquid lipstick, concealer or other cosmetic or cosmeceutical product. A dispensing portion 16 is connected with the body 12 and defines a bore 18 coupled in fluid communication with the storage chamber 14 for receiving substance therefrom, and an outlet aperture 20 coupled in fluid communication with the bore 18. A piston assembly 22 is received within the bore 18, and a dispensing nozzle or one-way valve 24 is mounted on the dispensing portion 16 for dispensing metered amounts of product or other substance therethrough. The one-way valve 24 includes an axially-extending valve seat 26 (shown in phantom in FIG. 6), and an axially-extending flexible valve cover 28 seated on the valve seat and defining a normally-closed, axially-extending seam 30 therebetween forming a fluid-tight seal between the valve cover 28 and valve seat 26. As described further below, the flexible valve cover 28 is movable relative to the valve seat 26, and the seam 30 is connectable in fluid communication with the outlet aperture 20 to allow the passage of product through the seam and out of the dispenser. An actuator 32 is drivingly connected to the piston assembly 22 for moving the piston within the bore 18 and dispensing a predetermined amount of product within the bore through the outlet aperture 20 and one-way valve 24. A cover assembly 34 extends adjacent to and covers the dispensing portion 16, and includes an upper cover 36 and a lower cover 38, each pivotally mounted to the body 12 and movable between a closed position, as shown typically in FIG. 6, and an open position, as shown typically in FIG. 7.

Figure 6:
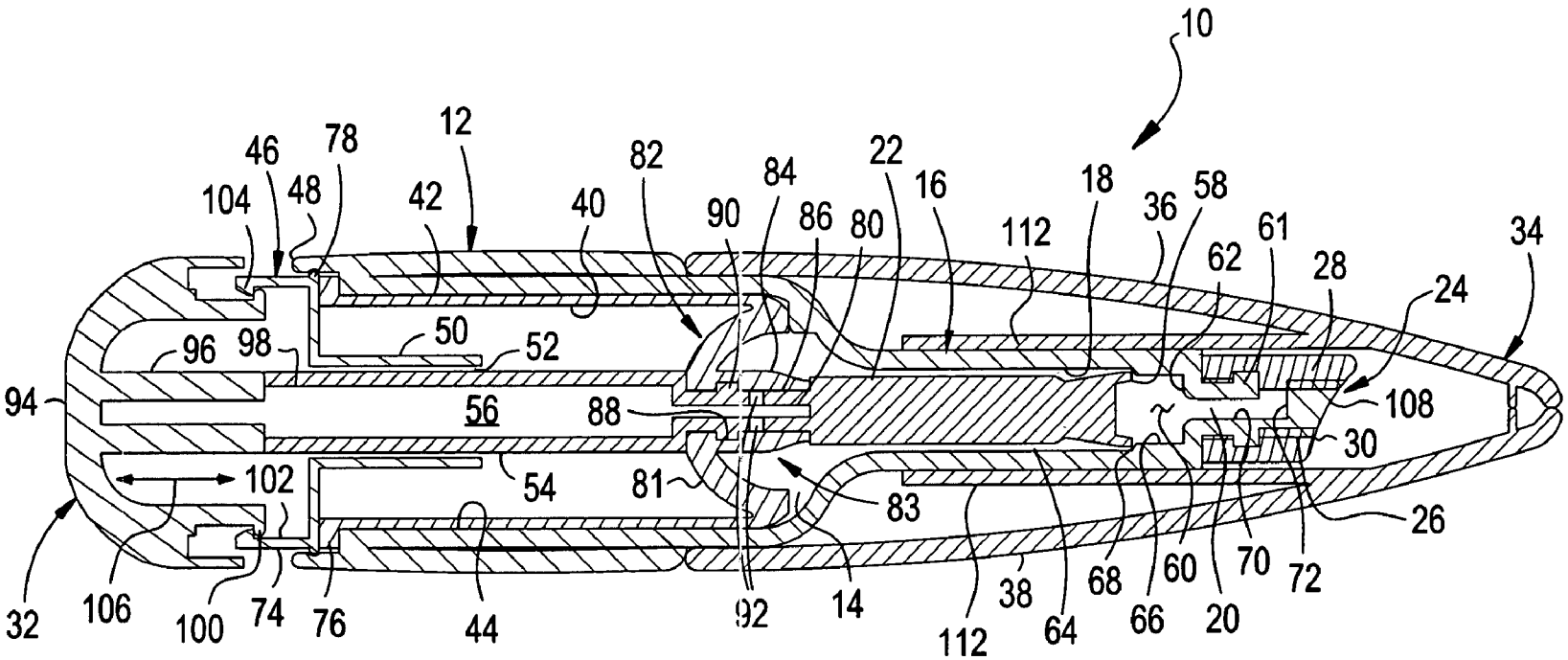
FIG. 6 is a cross-sectional view of the dispenser of FIG. 1 with both covers closed.

As shown typically in FIG. 6, the dispenser 10 further comprises a flexible bladder 40 mounted within the body 12 and defining the storage chamber 14 between the bladder and body. The bladder 40 defines a first axially-extending, annular surface 42, and the body 12 defines a second axially-extending, annular surface 44 facing the first surface 42 of the bladder and forming the storage chamber 14 therebetween. The first surface 42 of the bladder 40 is movable radially inwardly and away from the second surface 44 of the body 12 to expand the volume of the storage chamber 14 and receive a substance, such as a liquid lipstick, concealer, or other cosmetic or cosmeceutical product therein. The first surface 42 of the bladder 40 also is movable radially outwardly toward the second surface 44 of the body 12 upon dispensing therefrom the substance contained with the storage chamber 14. In FIG. 6, the bladder 40 is shown in the fully-expanded condition (i.e., when the storage chamber 14 is empty). However, as will be recognized by those of ordinary skill in the pertinent art based on the teachings herein, when filled with a substance, such as a liquid lipstick or other cosmetic or cosmeceutical product, the first surface 42 flexes radially inwardly and away from the second surface 44 of the body to define the variable volume storage chamber 14 therebetween.

As shown in FIG. 6, a cap 46 is coupled to an open end 48 of the body 12 and includes a piston flange 50 defining a piston aperture 52 formed therethrough. The piston assembly 22 includes a drive portion 54 defining a fill conduit 56 therein. The drive portion 54 of the piston assembly is received through the piston aperture 52, and the piston is movable within the aperture between a first or rest position, as shown typically in FIGS. 6 and 15A, with the piston tip 58 spaced away from the outlet aperture 20 and defining a compression chamber 60 therebetween, and a second fully-activated position, shown typically in FIG. 15B, with the piston tip 58 located adjacent to, or in contact with a stop surface 62 formed at the distal end of the bore 18 for dispensing a predetermined amount of substance within the compression chamber through the outlet aperture 20.

As indicated above, the dispensing nozzle 24 includes a relatively rigid valve seat 26 and a flexible valve cover 28 mounted over the valve seat and defining the axially elongated, annular seam or interface 30 therebetween. As shown in FIG. 6, the body 12 defines a periphal lobe 61 that is received within a corresponding groove formed in the base of the valve cover to fixedly secure the valve cover to the valve seat. As described further below, the piston assembly 22 forces a metered dose of fluid or other substance at sufficient pressure to open the valve (the "valve opening pressure") and force the fluid or other substance through the valve interface 30 and out of the dispenser. The valve cover 28 preferably forms an interference fit with the valve seat 26 to thereby form a fluid-tight seal in the normally closed position and, in turn, maintain the fluid or other substance within the dispenser in a sterile and hermetically sealed condition. Further, as shown typically in FIG. 14, the valve cover 24 defines a substantially tapered cross-sectional shape moving in the axial direction from the interior toward the exterior of the valve. This configuration requires progressively less energy to open each respective annular portion of the valve when moving axially from the interior toward the exterior of the valve. Alternatively, or in combination with the tapered valve cover, the valve seat may define an outer diameter that progressively or otherwise increases in the axial direction toward the valve tip, to provide the same or similar effect. As a result, once the base of the valve is opened, the pressure is sufficient to cause the respective axial segments of the valve cover 28 to progressively open and then close after passage of fluid therethrough when moving in the axial direction toward the valve tip to dispense a metered dose. Also, when dispensing a metered dose, preferably a substantially annular segment of the valve cover 28 substantially always engages the valve seat 26 to maintain the fluid-tight seal across the valve 24 and thereby prevent ingress through the valve of germs, bacteria or other unwanted substances and into the storage chamber 14.

Figure 15A:
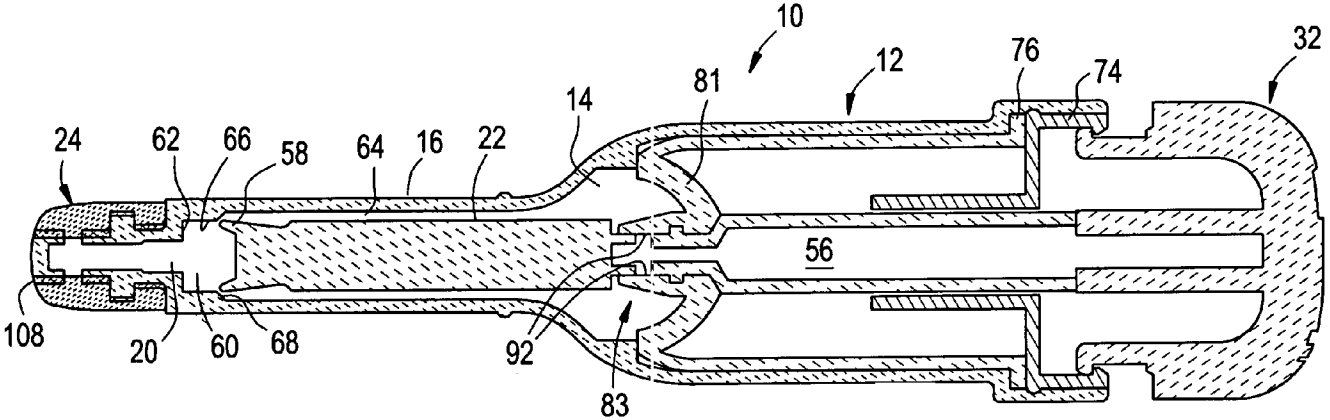
FIG. 15A is a cross-sectional view of the dispenser of FIG. 1 with the covers removed for clarity and showing the piston in a rest position.
Figure 15B:
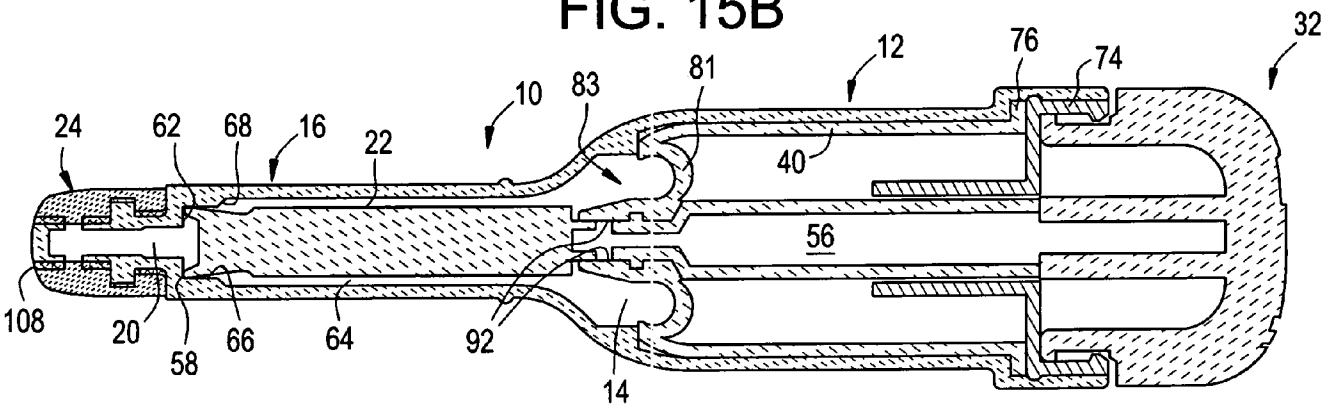
FIG. 15B is a cross-sectional view of the dispenser of FIG. 15A showing the piston in an actuated position.

The dispensing portion 16 is formed integral with the body 12 and is formed of a relatively rigid material defining therein the axially elongated bore 18. The piston assembly 22 is slidably received within the bore 18 and the piston tip 58 is formed on the free end thereof. The dosage or compression chamber 60 is formed between the piston tip 58 and the stop surface 62 formed on the axially inner side of the valve seat 26. An annular fluid conduit 64 extends axially between the piston body 22 and the bore 18 and, when the piston is located in the rest position as shown in FIGS. 6 and 15A, the fluid conduit 64 is coupled in fluid communication between the dosage chamber 60 and storage chamber 14 for dispensing fluid from the storage chamber into the dosage chamber on the return stroke of the piston.

The bore 18 defines a reduced cross-sectional portion 66 that cooperates with the piston tip 58 to define the volume of the dosage chamber 60 and thus the dosage volume of the dispenser. The axial extent of the reduced portion 66 defines a compression zone within which the fluid or other substance is compressed by the piston 22 and, in turn, forced through the dispensing nozzle 24. Thus, as shown best in FIG. 6, the bore 18 defines the compression zone formed within the reduced cross-sectional portion 66, and a tapered portion 68 formed between the compression zone and the annular fluid conduit 64. As described further below, the piston 22 is movable relative to the bore 18 (or vice-versa, if desired) between (i) a rest position shown in FIG. 15A with the tip 58 of the piston 22 axially spaced inwardly relative to the tapered portion 68 of the bore to allow fluid communication between the storage chamber 14, fluid conduit 64, and dosage chamber 60; (ii) to a fully-actuated position shown in FIG. 15B with the sealing surface of the tip 58 of the piston 22 received within the reduced cross-sectional portion 66 of the bore and adjacent to, or in contact with, the stop surface 62 of the bore; and (iii) back again to the rest position of FIG. 1SA upon release of the actuator 32. As shown in FIG. 6, the sealing tip 58 slidably contacts, and preferably forms an interference fit with the reduced cross-sectional portion 66 to thereby form a substantially fluid-tight seal therebetween In the rest position (FIG. 15A) and at the start of the outer stroke of the piston 22 (i.e., in the direction from the storage chamber 14 toward the nozzle 24), the compression zone 60 is in fluid communication with the fluid conduit 64 and storage chamber 14, and thus the fluid is permitted to flow both forwardly in front of the piston, and rearwardly back over the sides of the piston tip 58. Then, when the sealing surface of the piston tip 58 slidably engages the tapered portion 68 and, in turn, the reduced portion 66, a fluid-tight seal is formed therebetween, trapping a precise volume of fluid within the compression zone 60 and forcing the precise volume of fluid through the valve 24. As shown in FIG. 6, the sealing tip 58 of the piston 22 defines a substantially frusto-conical, cross-sectional shape. In addition, both the piston tip 58 and reduced portion 66 of the compression zone are formed of relatively rigid plastic materials and are dimensioned to form a fluid-tight annular seal when slidably engaging one another. The frusto-conical shape of the piston 58 facilitates slight inward flexing of the piston tip when received within the compression zone. In the illustrated embodiments of the present invention, the dispenser body is made of a relatively hard plastic material, such as any of the plastics sold under the trademarks Topaz™, Surlyn™, and Zeonex™. The piston, on the other hand, may be made of a softer grade of hard plastic in comparison to the body, such as any of numerous different brands of polypropylene, or the plastic sold under the trademark Alathon™.

As may be recognized by those of ordinary skill in the pertinent art based on the teachings herein, the shape and materials of construction are only exemplary, and numerous other shapes and/or materials of construction equally may be employed. For example, if desired, the piston tip may be formed of a resilient material that is attached to the end of the piston assembly. However, one advantage of the integral, relatively hard plastic piston as shown in FIG. 6, for example, is that it eliminates any such additional resilient part, thus reducing the overall cost and providing a design that reliably seals the compression zone from one dispenser to the next.

Figure 14:
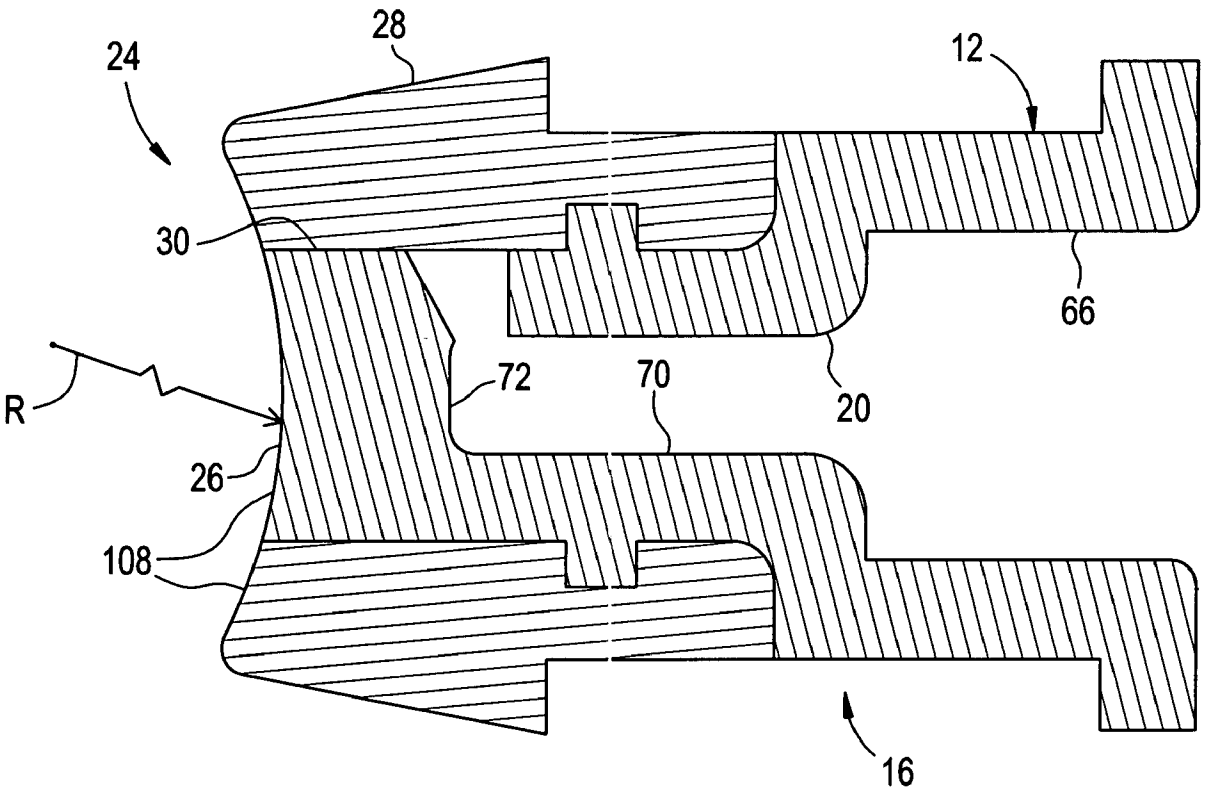
FIG. 14 is a cross-sectional view of the dispensing tip of the dispenser of FIG. 1 with parts removed for clarity.

As shown in FIGS. 6 and 14, the outlet aperture 20 includes a first portion 70 extending substantially axially adjacent to the bore 18, and a second portion 72 extending substantially radially between the first portion 70 and the seam 30. As described further below, the illustrated embodiment of the present invention includes a single, angular extending outlet aperture 20 for delivering the metered dosage. If desired, additional outlet apertures could be added (e.g., a second outlet aperture of the same or different size diametrically opposed to the illustrated aperture 20), or the aperture 20 could be moved to another position than the position shown (e.g., the single outlet aperture could be located on the opposite side of the valve seat than that shown) The valve cover 28 is preferably made of an elastomeric material, such as the polymeric material sold under the trademark Kraton™, or a vulcanized rubber or other polymeric material. As may be recognized by those of ordinary skill in the pertinent art based on the teachings herein, however, these materials are only exemplary, and numerous other materials that are currently or later become known for performing the function of the valve cover equally may be used.

As may be recognized by those of ordinary skill in the pertinent art based on the teachings herein, the construction of many aspects of the dispenser 10, including aspects of the body, flexible bladder, pump or piston, and nozzle, may be the same as or similar to that described in co-pending U.S. Pat. No. 6,761,286 entitled "Fluid Dispenser Having a Housing and Flexible Inner Bladder"; and/or U.S. patent application Ser. No. 10/691,270, filed Oct. 21, 2003, entitled "Ophthalmic Dispenser and Associated Method", and/or U.S. patent application Ser. No. 10/519,691, entitled "One-way Actuation Release Mechanism for a System for Applying Medicament⇆, filed Apr. 10, 2003 as a reissue of U.S. Pat. No. 6,213,982, and/or U.S. provisional application Ser. No. 60/519,961, filed Nov. 14, 2003, entitled "Delivery Device and Method of Delivery", filed Nov. 14, 2003; and/or U.S. provisional application Ser. No. 60/582,225, filed Jun. 23, 2004, entitled "Delivery Device with Compliance Monitor and Method"; each of which is assigned to the Assignee of the present invention, and is hereby expressly incorporated by reference as part of the present disclosure.

As shown in FIG. 6, the end cap 46 of the dispenser includes a mounting flange 74 that is received within the open end 48 of the body 12 and fixedly secured thereto. The flexible bladder 40 defines an annular sealing flange 76 that is compressed between the flange 74 of the end cap 46 and the body 12 to form a fluid-tight seal therebetween. The flange 74 of the cap 46 defines one or more peripheral lobes 78 that are snap-fit into corresponding annular recesses of the body to fixedly secure the cap to the body with the sealing flange 76 of the bladder compressed therebetween.

As shown in FIG. 6, a base portion 82 of the bladder defines a substantially-dome shaped spring 81 for normally biasing the piston assembly 22 away from the outlet aperture 20 and into the rest position, as shown in FIGS. 6 and 15A, and a filling valve 83 for sterile filling the storage chamber 14 with a fluid or other substance introduced through a filling probe (not shown) that is inserted or otherwise coupled in fluid communication with the fill conduit 56 of the piston assembly. As shown in FIG. 6, the piston assembly 22 defines at the base of the fill conduit 56 an axially-extending valve seat 80, and the base portion 82 of the flexible bladder 40 defines a flexible valve cover 84 of the filling valve 83 that overlies the valve seat 80 to thereby define an annular, axially-extending valve interface or seam 86 therebetween. Preferably, the flexible valve cover 84 and valve seat 80 form an interference fit to thereby maintain a fluid-tight seal when the valve is in the normally closed position. The base portion 82 of the bladder further defines an annular recess 88 that receives therein a corresponding annular lobe 90 formed on the piston assembly 22 to fixedly secure the base portion 82 of the bladder to the piston. The flexible valve cover 84 preferably defines a substantially tapered, or progressively reduced wall thickness when moving axially in the direction of the inlet to the valve toward the interior of the dispenser. This configuration requires progressively less energy to open each respective annular portion of the valve when moving axially from the inlet to the valve toward the interior of the dispenser. As a result, once the base of the valve is opened, the pressure is sufficient to cause the respective axial segments of the valve cover 84 to progressively open and then close after passage of fluid therethrough when moving in the axial direction. Alternatively, or in combination with the tapered valve cover, the valve seat may define an outer diameter that progressively or otherwise increases with moving in the axial direction from the inlet of the valve toward the interior of the dispenser, to provide the same or similar effect. Preferably, a substantially annular segment of the valve cover 84 substantially always engages the valve seat 80 to maintain the fluid-tight seal across the filling valve and thereby prevent ingress through the valve of germs, bacteria or other unwanted substances. The piston assembly 22 further defines one or more fill openings 92 extending through the valve seat 80 and coupled in fluid communication between the fill conduit 56 and the valve interface or seam 86.

The dispenser 10 is filled by slidably receiving a probe (not shown) within the fill conduit 56 such that the tip of the probe is located at the base of the fill conduit and adjacent to the inlet 92 to the filling valve 83. Then, fluid, such as a liquid lipstick or other cosmetic or cosmeceutical product, is introduced through the probe, through the inlet apertures 92 and valve interface or seam 86 of the filling valve 83, and into the storage chamber 14. The fluid is introduced through the probe at a pressure greater than the valve opening pressure of the filling valve 83 to open the valve and allow the fluid to flow therethrough. As the storage chamber 14 is filled with fluid, the bladder 40 correspondingly collapses to allow the variable volume chamber 14 to correspondingly expand and receive the fluid. Once the storage chamber 14 is filled with fluid, the probe is removed from the fill conduit 56, and the flexible valve cover 84 seals against the valve seat 80 to hermetically seal the fluid within the dispenser. The filling cannula or probe, and other aspects of the filling apparatus and method for filling the dispensers of the present invention may be the same as or similar to that disclosed in U.S. patent application Ser. No. 10/843,902, filed May 12, 2004, entitled "Dispenser and Apparatus and Method for Filling a Dispenser", which is assigned to the Assignee of the present invention and is hereby expressly incorporated by reference as part of the present disclosure.

The bladder 40 (including the integral valve member 83 and dome-shaped spring 81) is preferably made of an elastomeric material that is relatively soft in comparison to the body 12 and valve seat 80 of the piston assembly. For example, the bladder 12 may be made of a polymeric material, such as one of the materials sold under the trademarks Kraton™ or Santoprene™ (e.g., Santoprene 8211-35), or a vulcanized rubber or other polymeric material. However, as may be recognized by those of ordinary skill in the pertinent art based on the teachings herein, these materials are only exemplary, and numerous other materials that are currently, or later become known for performing the functions of the bladder and/or valve member equally may be used.

As shown in FIG. 6, when the dispenser is empty, the bladder 40 is fully expanded into engagement with the interior surface 44 of the body 12 such that the variable volume storage chamber 14 is at substantially zero volume. As described in the above-mentioned co-pending patent applications, the bladder 40 is preferably formed such that it naturally tends to flex outwardly and create a positive pressure gradient on the fluid or other substance in the storage chamber 14. Also, in this position, the valve member 84 of the filling valve 83 is in the normally closed position to maintain the interior of the dispenser hermetically sealed. In this condition, the empty dispenser may be sterilized prior to filling, such as by applying gamma, e-beam, or another type of radiation thereto. Then, the sealed, empty and sterilized dispenser may be transported to a sterile filling machine or other filling station without risk of contaminating the sterilized interior portions of the dispenser.

As may be recognized by those of ordinary skill in the pertinent art based on the teachings herein, the spring 81 may take any of numerous different shapes and/or configurations, or may be formed of any of numerous different materials, that are currently, or later become known for performing the function of the spring as described herein.

For example, the spring may define a shape other than a dome shape, or may not be formed integral with the bladder or the valve member. For example, the spring could take the form of a coil or other type of spring, that may be made of metal, plastic, or any of numerous other materials, for biasing the piston assembly as described herein. Also, the shape and/or material of construction of the spring may be selected to control the spring force applied to the piston assembly. One advantage of the substantially dome-shaped configuration, however, is that the dome shape imparts lateral (or radial) and axial forces to the piston assembly 22 to facilitate maintaining sufficient force to drive the piston from the fully-actuated to the rest position throughout the shelf-life and usage of the dispenser 10. Yet another advantage of the illustrated embodiment of the present invention is that by forming the spring integral with the base portion of the bladder, a separate part that otherwise would be required to bias the piston assembly, is eliminated.

As shown in FIG. 6, the actuator 32 includes a manually engageable portion 94 that is drivingly connected through a flange 96 on the inner side thereof to the free end 98 of the piston assembly 22. The actuator 32 defines a peripheral lobe 100 that is slidably received within an axially-extending, peripheral groove 102 formed on the inner side of the flange 74 of the end cap 46. As can be seen, the peripheral lobe 100 of the actuator is captured within the annular groove 102 by a peripheral lobe 104 formed on the outer end of the end cap 46. As indicated by the arrows 106 in FIG. 6, the manually-engageable portion 94 of the actuator is axially depressible inwardly against the bias of the dome-shaped spring 81 to move drive the piston from the rest position shown in FIG. 15A to the fully-actuated position shown in FIG. 15B. As described above, this inner stroke of the piston 22 forces a predetermined amount of substance through the one-way valve 24 and onto an applicator surface 108 formed by the distal end portions of the valve cover 28 and valve seat 26. Then, when the user releases the manually engageable portion 94, the dome-shaped spring 81 drives the piston assembly 22 in a return stroke from the fully-actuated position shown in FIG. 15B to the rest position shown in FIG. 15A. On the return stroke, fluid, such as a liquid lipstick or other cosmetic, contained with the storage chamber 14, flows through the annular conduit 64 and into the compression chamber 60. This displacement of fluid, in turn, causes the flexible bladder 40 to correspondingly expand in the radial direction to displace the volume of the dispensed fluid.

As shown, the applicator surface defines a curvilinear contour to substantially conform to the contour an application surface, such as facial tissue. In the illustrated embodiment, the contour is defined by a radius "R" dimensioned to comformably contact a user's lips for purposes of applying a metered dose of liquid lipstick thereto. However, as may be recognized by those of ordinary skill in the pertinent art based on the teachings herein, this specific shape of the applicator surface may take any of numerous different such shapes that are currently or later become known for performing the function of the applicator surface as described herein. For example, the applicator surface may take any of a variety of different forms designed to substantially conformably contact a user's eyelids, eyebrows, eyelashes, cheeks, toenails, fingernails, etc.

Figure 7:
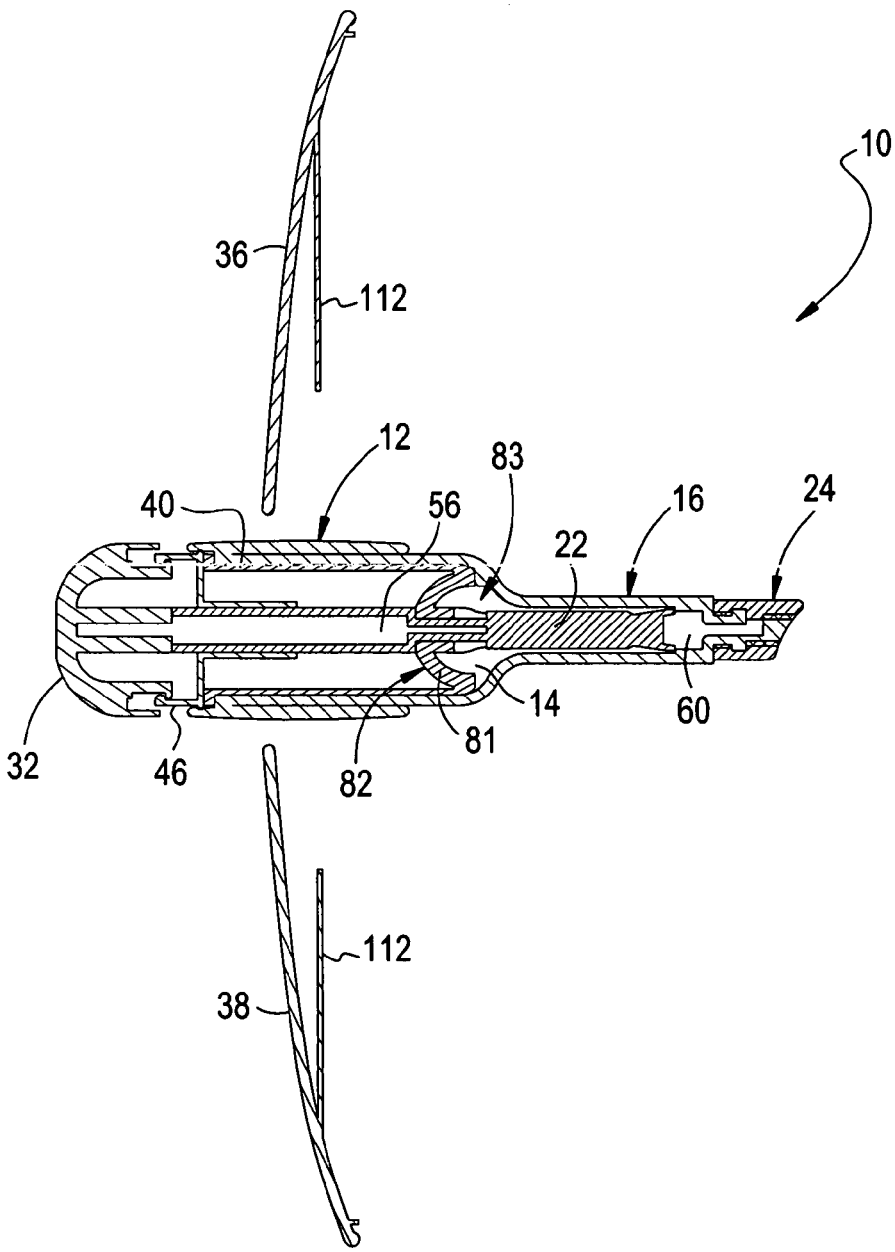
FIG. 7 is a cross-sectional view of the dispenser of FIG. 1 with both covers open.
Figure 8:
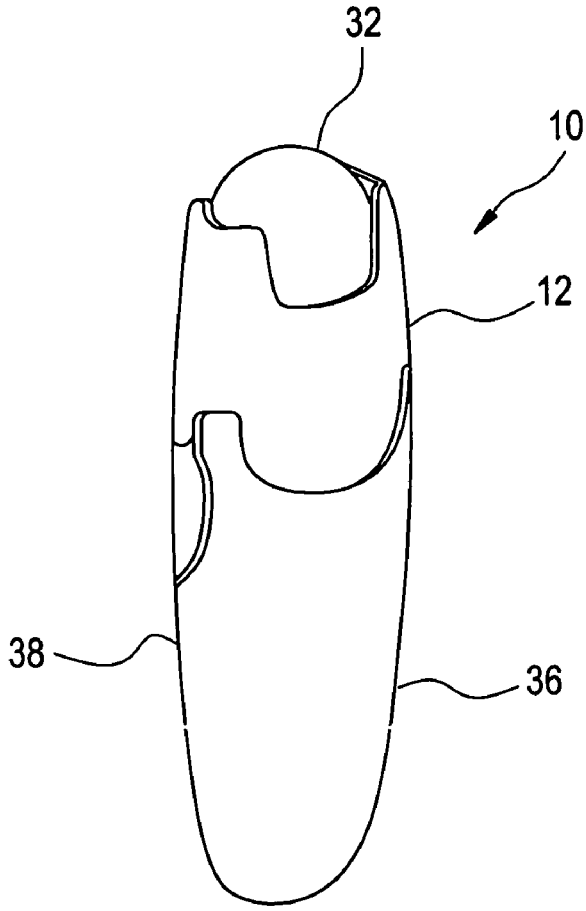
FIG. 8 is a perspective view of the dispenser of FIG. 1 with both covers closed.
Figure 9:
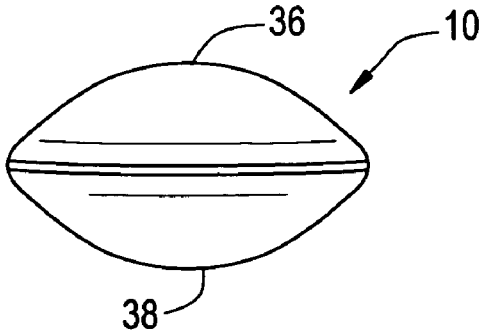
FIG. 9 is a front elevational view of the dispenser of FIG. 9 with both covers closed.
Figure 10:
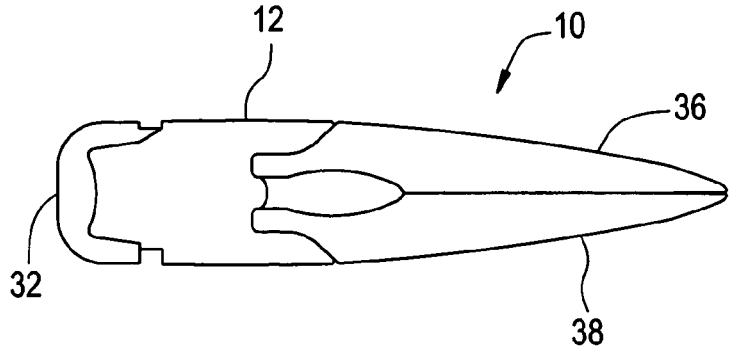
FIG. 10 is a side elevational view of the dispenser of FIG. 1 with both covers closed.
Figure 11:
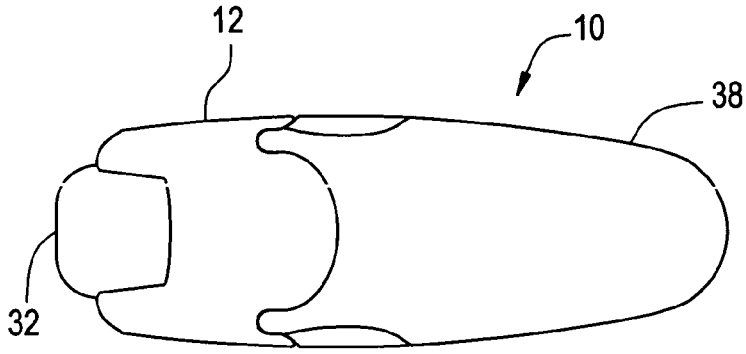
FIG. 11 is a plan view of the dispenser of FIG. 1 with both covers closed.
Figure 12:
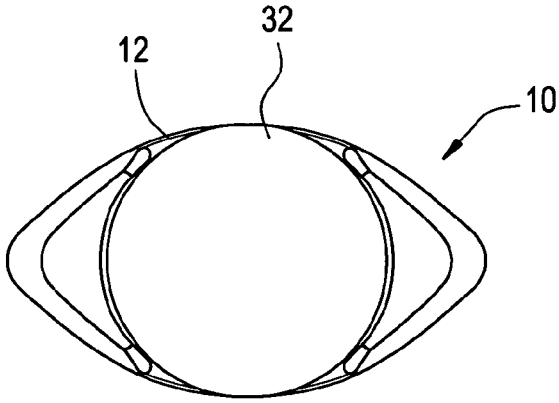
FIG. 12 is an end elevational view of the dispenser of FIG. 1 with both covers closed.
Figure 13:
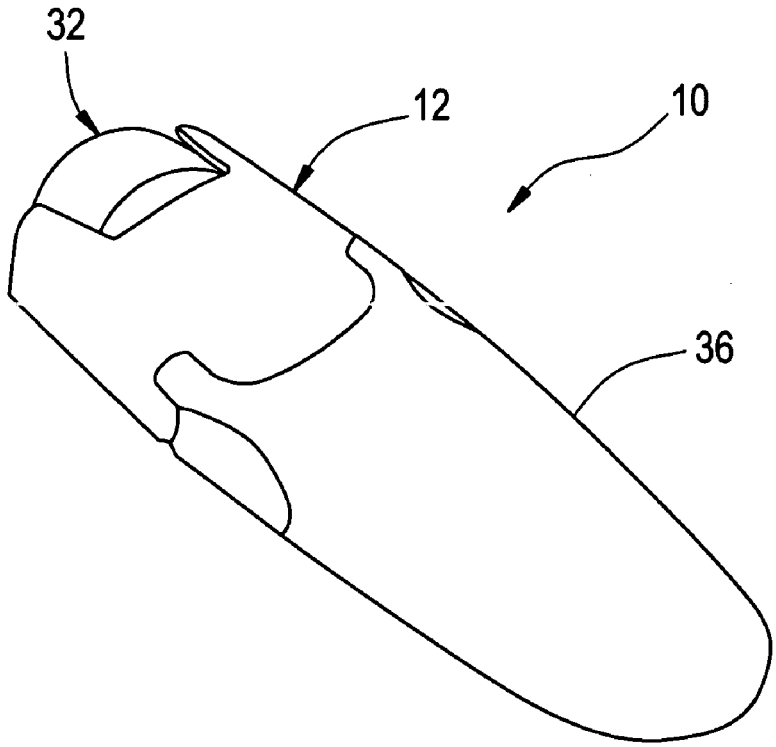
FIG. 13 is another perspective view of the dispenser of FIG. 1 with both covers closed.

As shown typically in FIG. 6, the upper and lower covers 36, 38 of the dispenser 10 are pivotally mounted to the body 12 and located on opposite sides of the body relative to each other. As shown, each cover 36, 38 is movable between a closed position covering a respective side of the dispensing portion 16 and an open position exposing the respective side of the dispensing portion. Each cover 36, 38 includes a reflective or mirror-like surface 112 on an interior side thereof. As shown in FIG. 7, when each cover 36, 38 is pivoted to the fully-open position, the plane of each reflective surface 112 is substantially normal to the axis of the body 12. Each reflective surface 112 is configured to reflect a visible image of at least a portion of the dispensing portion thereon. In the illustrated embodiment, the reflective surfaces 112 reflect a visible image thereon of the user's lips and the dispensing tip or one-way valve 24 to facilitate applying the metered dosages of liquid lipstick in a desired manner thereto. The reflective surfaces may take the form of any of numerous different reflective or mirror-like surfaces that are currently or later become known for performing the function of the reflective surfaces as described herein.

As shown in FIG. 1, the body 12 defines axially-extending attachment arms 114 located on opposite sides of the body 12 relative to each other, and each attachment arm includes an attachment aperture 116 formed through an end portion thereof. Each cover 36, 38 includes a pair of pivot pins 118 formed on opposite sides of the base portion thereof, and received within corresponding pin apertures (not shown) in the body 12. The pivot pins 18 and corresponding pin apertures may be constructed, and/or the covers may be pivotally mounted to the body, in accordance with any of numerous different configurations that are currently or later become known for performing the function of pivotally or otherwise movably mounting each cover to the base. For example, if desired, the pivot pins and pin apertures may form interference fits with each other to provide a frictional resistance or drag to, in turn, provide a smooth pivoting action and/or to allow the cover to be pivoted to any of numerous different angular positions and to hold itself in any such position. Each cover includes on an inner side thereof a releasable locking tab 120 that is snap-fit or otherwise received within the corresponding attachment aperture 116 to releasably secure each cover in the closed position.

In the operation of the dispenser 10, a user may grasp the dispenser in one hand and flip open the covers 36, 38 as shown, for example, in FIG. 7. Then, the user may axially depress with the index finger or other preferred digit of the same hand the manually engageable portion 94 of the actuator 32 to dispense a metered dose of liquid lipstick, or other substance contained within the dispenser, onto the applicator surface 108. If desired, the user may depress the actuator 32 with a finger of the hand not holding the dispenser; however, one advantage of the currently preferred embodiments of the present invention, is that the dispenser may be held and actuated with the same hand. In order to apply the metered dosage of liquid lipstick or other substance contained within the dispenser to the lips (e.g., for lip applications, the dispenser may alternatively contain a lip balm or other substance that may be applied to a person's lips), the user may look into one or both mirrors 112, 112 to view the dispensing tip and/or lip surfaces and apply the applicator surface 108 containing the substance thereon to the lips. Upon contacting the desired lip surface with the applicator surface 108, the applicator surface substantially conformably contacts the lip surface and facilitates uniformly applying the substance in a film-like manner thereto. With the assistance of the mirror(s) 112, the user may then move the applicator surface 108 along the lip surface to uniformly spread the liquid lipstick or other substance thereon. As additional liquid lipstick or other substance is required to cover additional surface portions of the lips, the user may then axially depress the actuator 32 in the same manner as described above and repeat the application until the liquid lipstick or other substance is suitably applied.

One advantage of the currently preferred embodiments of the present invention, is that once a metered dosage is dispensed, the piston tip 58 returns to its rest position, as shown typically in FIG. 6, and thus substantially equalizes the pressure in the compression chamber 60 and the storage chamber 14. As a result, the liquid lipstick or other substance does not continue to flow through the valve. Thus, residual seepage of the liquid lipstick or other substance through the dispensing valve may be avoided. Yet another advantage of the dispenser of the present invention, is that the bulk of the liquid lipstick or other substance remains hermetically sealed in the storage chamber throughout the shelf life and usage of the dispenser. Yet another advantage of the dispensers of the present invention is that the one-way valve substantially prevents any germs, bacteria or other unwanted substances from entering the dispenser and contaminating the bulk of the liquid lipstick or other substance or product contained within the dispenser. Accordingly, if desired, the dispensers of the present invention may be used to store and dispense multiple doses of sterile substances and/or preservative-free substances.

Figure 16:
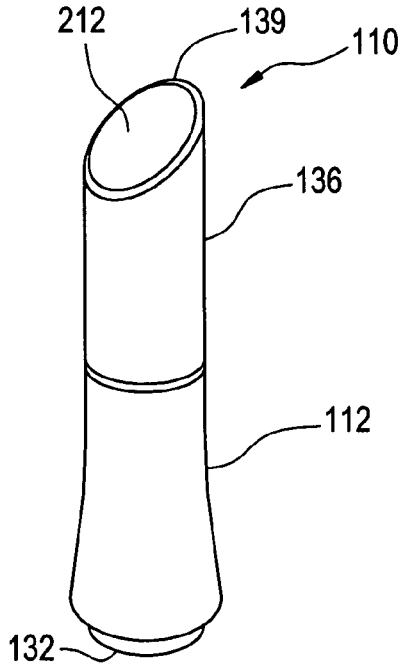
FIG. 16 is a perspective view of another embodiment of a dispenser of the present invention including a single cover that is removably mounted to the base and that includes a mirror or like reflective surface located on an exterior surface of the cover.
Figure 17:
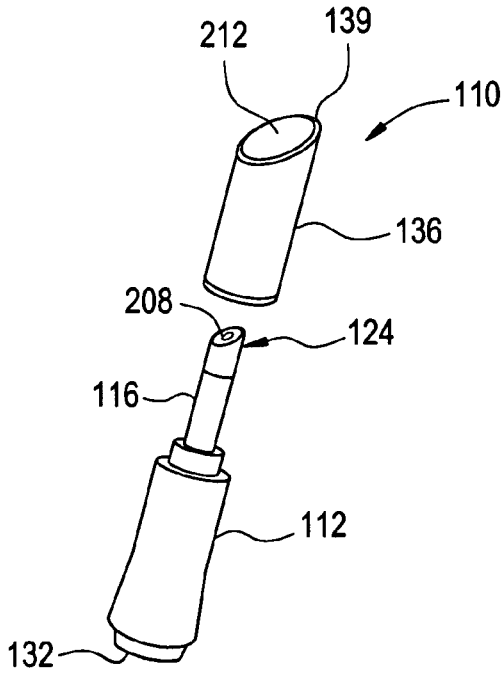
FIG. 17 is a perspective, exploded view of the dispenser of FIG. 16 showing the cover removed from the base.
Figure 18:
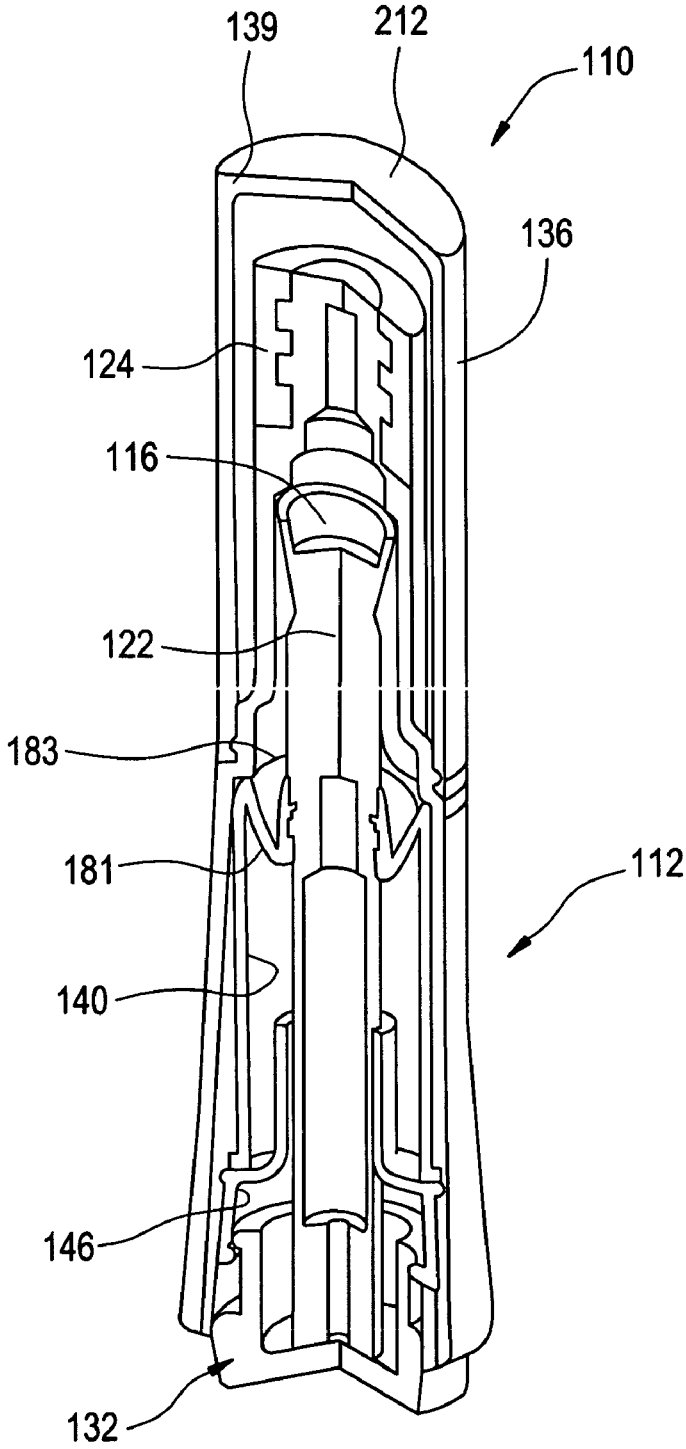
FIG. 18 is a perspective, partial cross-sectional view of the dispenser of FIG. 16.
Figure 19A:
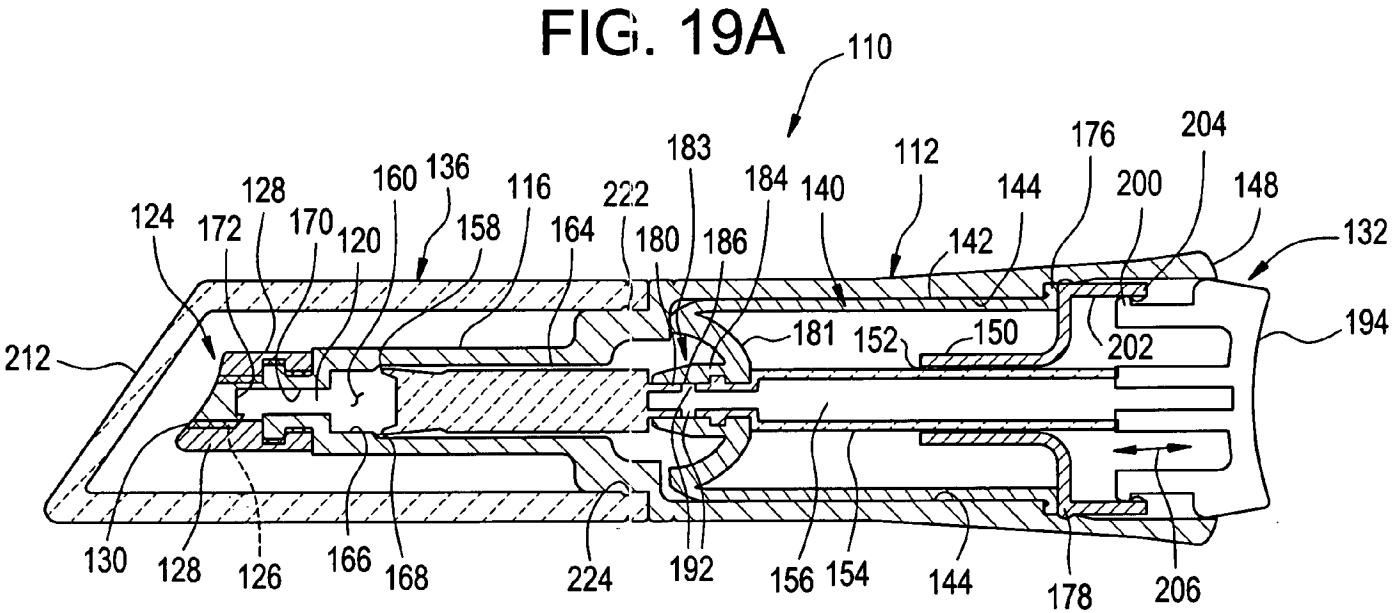
FIG. 19A is a cross-sectional view of the dispenser of FIG. 16.
Figure 19B:
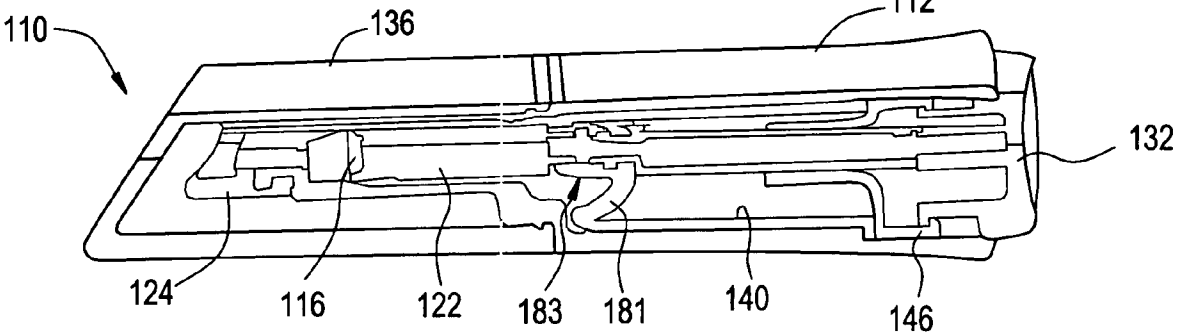
FIG. 19B is a perspective, partial cross-sectional view of the dispenser of FIG. 16.
Figure 20:
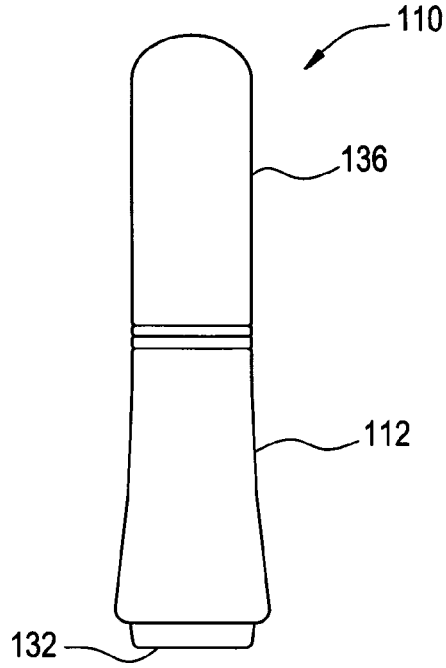
FIG. 20 is a side elevational view of the dispenser of FIG. 16.
Figure 21:
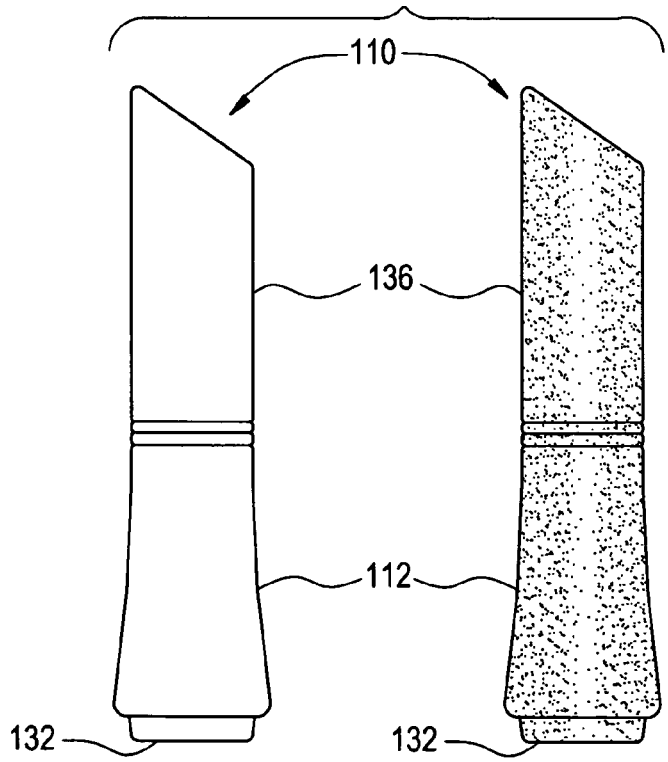
FIG. 21 includes two side elevational views of the dispenser of FIG. 16.
Figure 22:
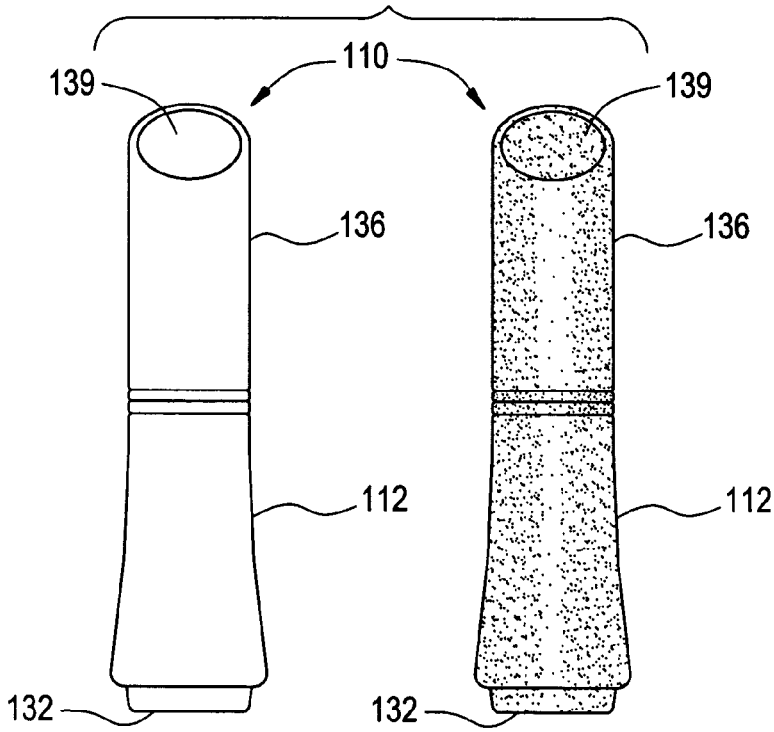
FIG. 22 includes two side elevational views of the dispenser of FIG. 16 without the mirror or like reflective surface mounted on an exterior surface of the cover.
Figure 23:
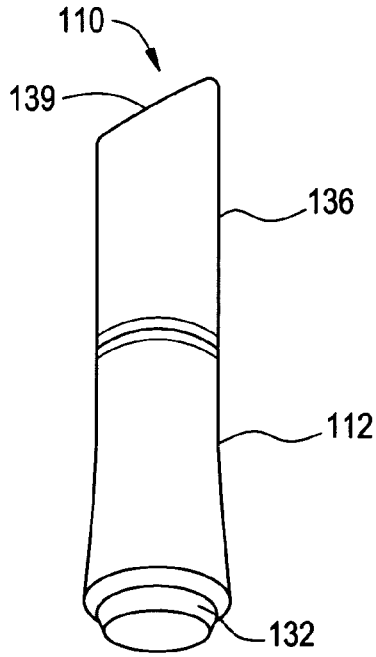
FIG. 23 is a bottom perspective view of the dispenser of FIG. 16.
Figure 24:
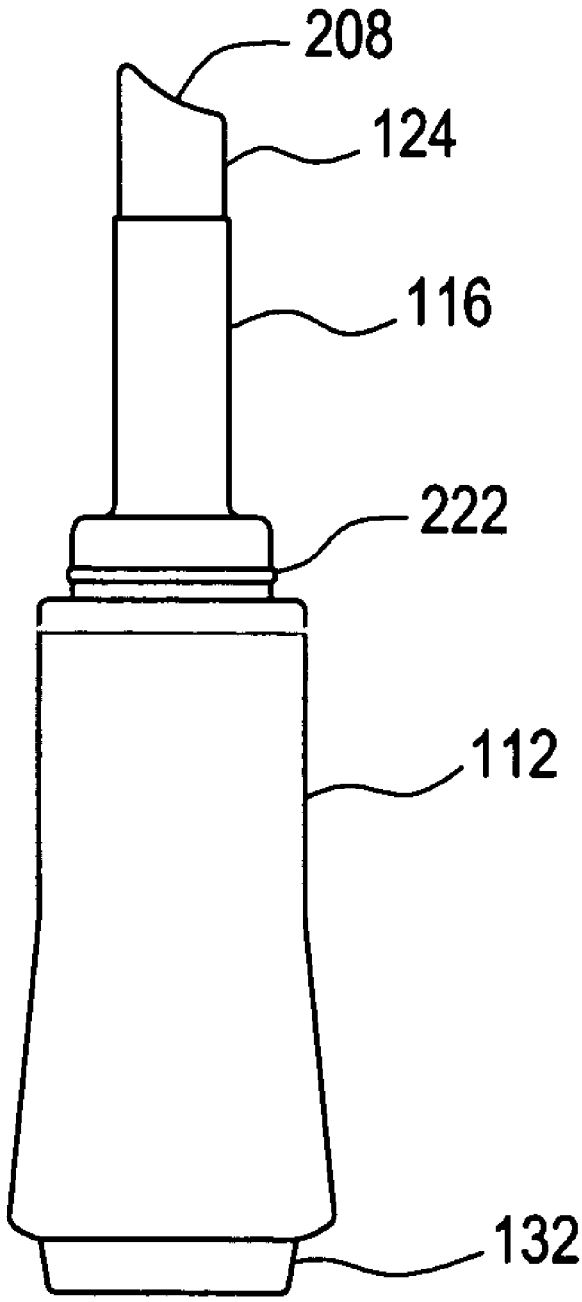
FIG. 24 is a side elevational view of the dispenser of FIG. 16 with the cover removed.

In FIGS. 16 through 24, another dispenser embodying the present invention is indicated generally by the reference numeral 110. The dispenser 110 is substantially similar to the dispenser 10 described above, and therefore like reference numerals preceded by the numeral "1", or preceded by the numeral "2" instead of the numeral "1", are used to indicate like elements. The primary difference of the dispenser 110 in comparison to the dispenser 10, is that the dispenser 110 includes a different shaped body 112 and a different cover 136. As shown in FIG. 16, the body 112 defines a substantially cylindrical shape that is flared outwardly at the base adjacent to the actuator 132. In addition, the dispenser 110 includes a single cover 136, as opposed to dual pivoting covers as described above. The cover 136 is substantially cylindrical shaped, and includes an end wall 139 that is oriented at an acute angle relative to the axis of the cover and dispenser. A mirror or other reflective surface 212 is mounted or otherwise applied to the exterior surface of the end wall 139. As shown in FIG. 19A, the body 112 defines at the base of the dispensing portion 116 a peripheral lobe 222, and the cover 136 defines on its interior surface a corresponding annular groove 224. In order to releasably secure the cover or cap 136 to the body 112, the body lobe 222 is snapped into the cover groove 224.

In the operation of the dispenser 110, a user may grasp the dispenser in one hand and remove the cover 136 with either hand. Then, the user may axially depress with the index finger or other preferred digit of the same hand the manually engageable portion 194 of the actuator 132 to dispense a metered dose of liquid lipstick, or other substance contained within the dispenser, onto the applicator surface 208. If desired, the user may depress the actuator 132 with a finger of the hand not holding the dispenser; however, one advantage of the currently preferred embodiments of the present invention, is that the dispenser may be held and actuated with the same hand. In order to apply the metered dosage of liquid lipstick or other substance contained within the dispenser to the lips (e.g., for lip applications, the dispenser may alternatively contain a lip balm or other substance that may be applied to a person's lips), the user may hold with the other hand the cover 136 and position and look into the mirror 212 of the cover to view the dispensing tip and/or lip surfaces and, in turn, apply the applicator surface 208 containing the substance thereon to the lips. Upon contacting the desired lip surface with the applicator surface 208, the applicator surface substantially conformably contacts the lip surface and facilitates uniformly applying the substance in a film-like manner thereto. The user may then move the applicator surface 108 along the lip surface, with or without the assistance of the mirror 212, to uniformly spread the liquid lipstick or other substance thereon. As additional liquid lipstick or other substance is required to cover additional surface portions of the lips, the user may then axially depress the actuator 132 in the same manner as described above and repeat the application until the liquid lipstick or other substance is suitably applied.

In FIGS. 25 through 32, another dispenser embodying the present invention is indicated generally by the reference numeral 310. The dispenser 310 is similar in certain respects to the dispenser 10 and 110 described above, and therefore like reference numerals preceded by the numeral "3", or preceded by the numeral "4" instead of the numeral "1" or "2", are used to indicate like elements. A primary difference of the dispenser 310 is that it includes a first body 312A that is slidably received and mounted within a second body 312B. The covers 336 and 338 are each pivotally mounted to the second body 312B. The actuator 332 includes a peripheral manually engageable portion 394, and as indicated by the arrows 406, the actuator is rotatably actuated, as opposed to being axially depressible, in order to dispense a metered dose of substance therefrom. Otherwise, the body 312A, dispensing portion 316, dispensing nozzle 324, and actuator 332, and the components mounted or otherwise located within the body 312A, are the same, or substantially the same as the dispenser disclosed, for example, in FIGS. 38–40 of U.S. patent application Ser. No. 10/272,577, filed Oct. 16, 2002, entitled "Dispenser with Sealed Chamber and One-Way Valve for Providing Metered Amounts of Substances", which is assigned to the Assignee of the present invention and is hereby expressly incorporated by reference as part of the present disclosure.

In this embodiment, as described in the above-mentioned co-pending patent application, a plurality of threads are formed on an upper guide portion of the piston which engage partial threads formed on the inner wall of the upper portion of the body 312A. The threads on the upper guide portion of the piston define a plurality of regions in which the thread diameter gradually increases, beginning from a diameter that corresponds to the diameter of the partial threads on the inner wall of the upper portion of the body 312A, to a diameter that is greater than the diameter of the partial threads. The largest diameter threads on the piston have a smaller diameter than the diameter or corresponding dimension of the body 312A between the partial threads.

As the actuator 332 and the piston connected thereto are rotated, as indicated by the arrow 406, the larger diameter threads on the piston are progressively engaged by the partial threads on the inner wall of the upper portion of the body 312A. This causes the upper portion of the body 312A to expand slightly. As the largest diameter threads on the piston disengage from the partial threads on the body 312A and enter the area between the partial threads, the body 312A rapidly returns to its original shape. When the larger diameter threads are located in the area between the partial threads, the piston assembly is locked in position until a sufficient rotational force is applied to the piston assembly to cause the larger diameter threads to engage the partial threads on the inner wall of the body 312A. By establishing the thread pitch as disclosed in the above-mentioned co-pending patent application, the distance of travel of the piston for each rotation of the piston through the threaded portions can be precisely controlled, resulting in delivery of a pre-determined amount of the substances for each incremental rotation of the piston.

Figure 25:
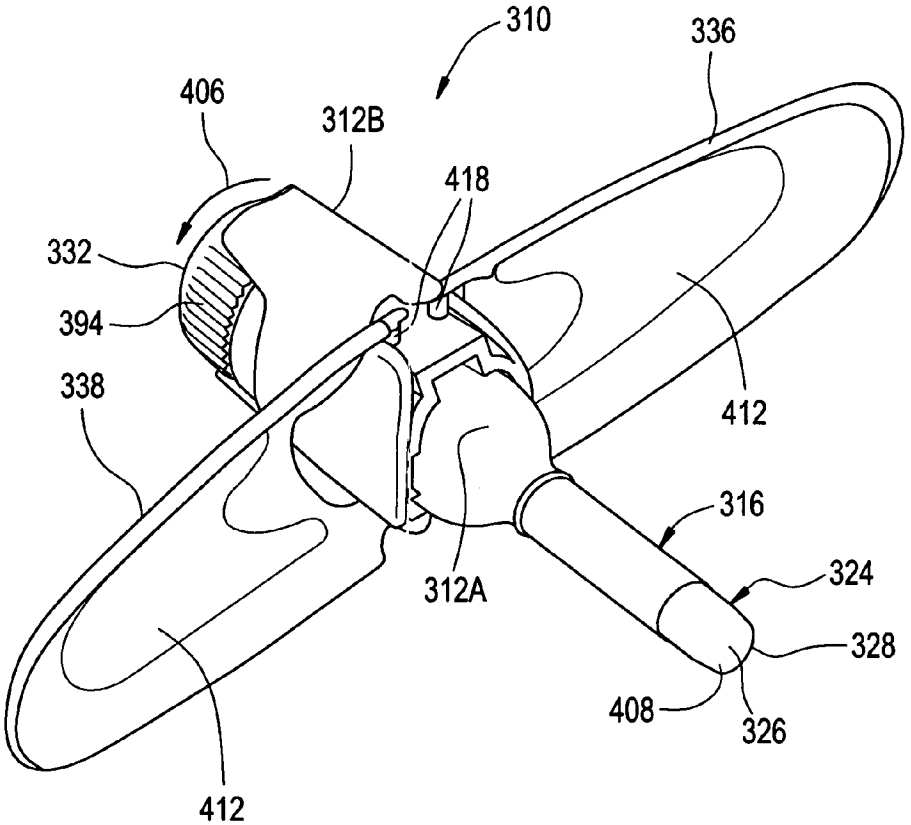
FIG. 25 is a perspective view of another embodiment of a dispenser of the present invention wherein the actuator is rotatably actuated to dispense metered dosages of substance through the one-way valve of the dispensing nozzle, and showing both covers open with the mirror or like reflective surfaces thereof exposed.
Figure 26:
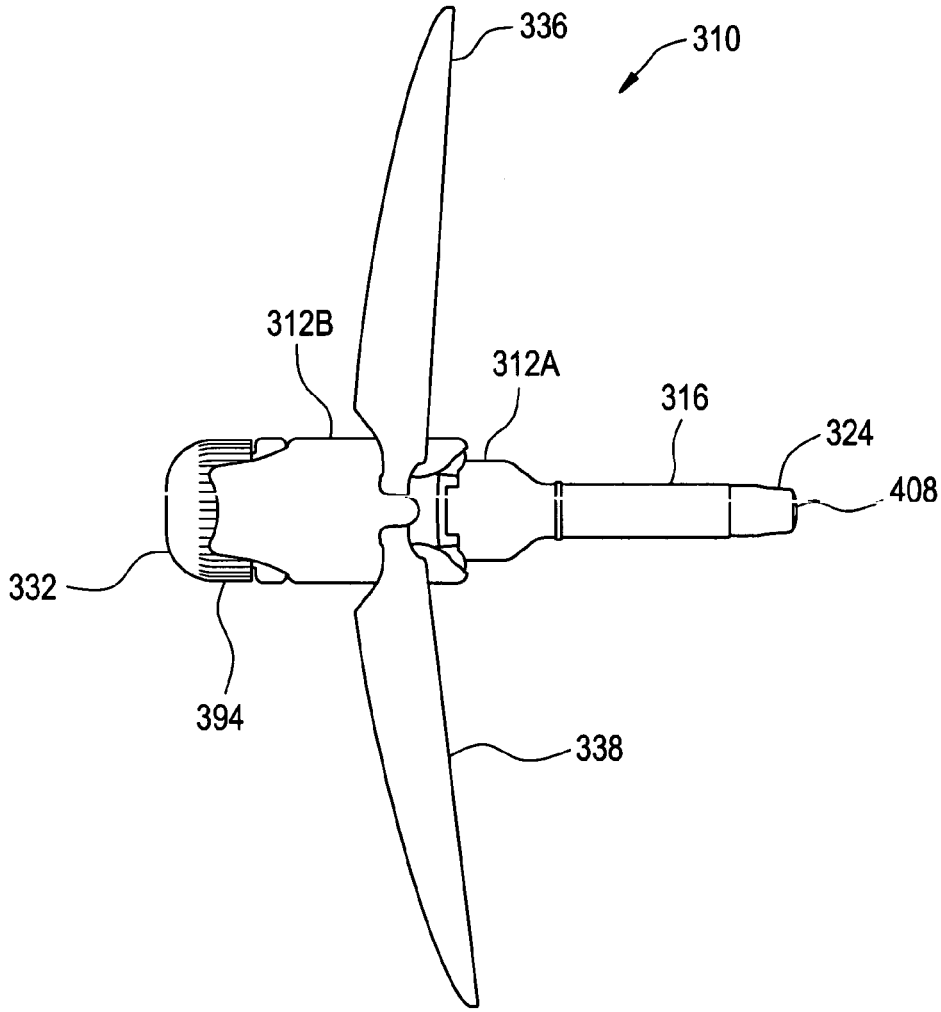
FIG. 26 is a side elevational view of the dispenser of FIG. 25 with both covers open.
Figure 27:
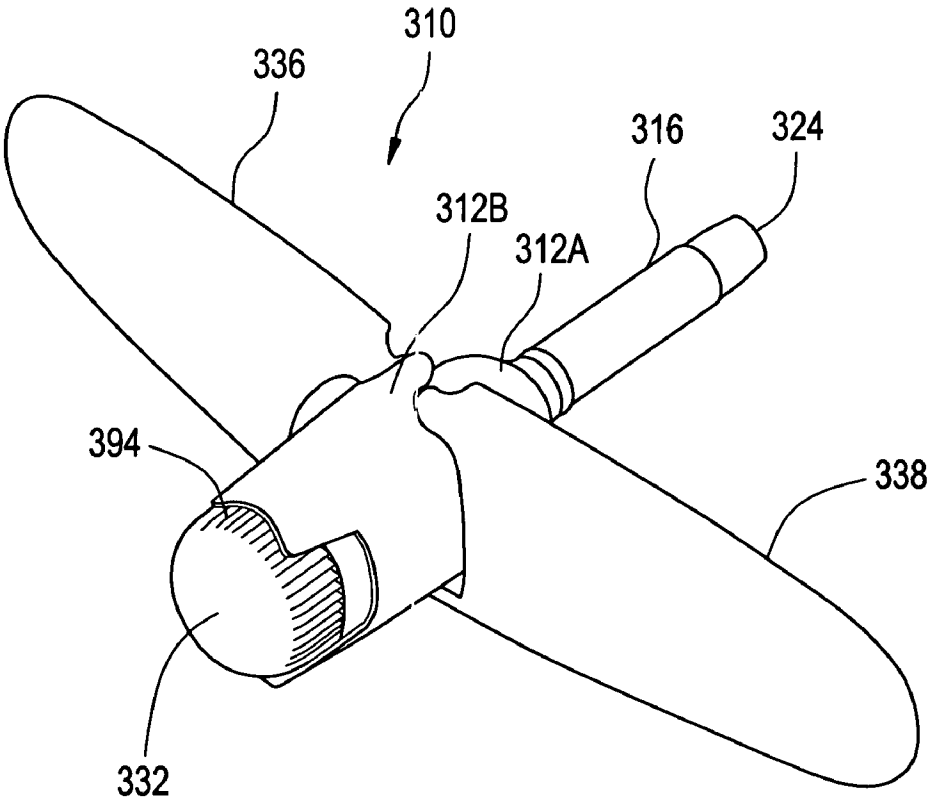
FIG. 27 is a rear perspective view of the dispenser of FIG. 25 with both covers open.
Figure 28:
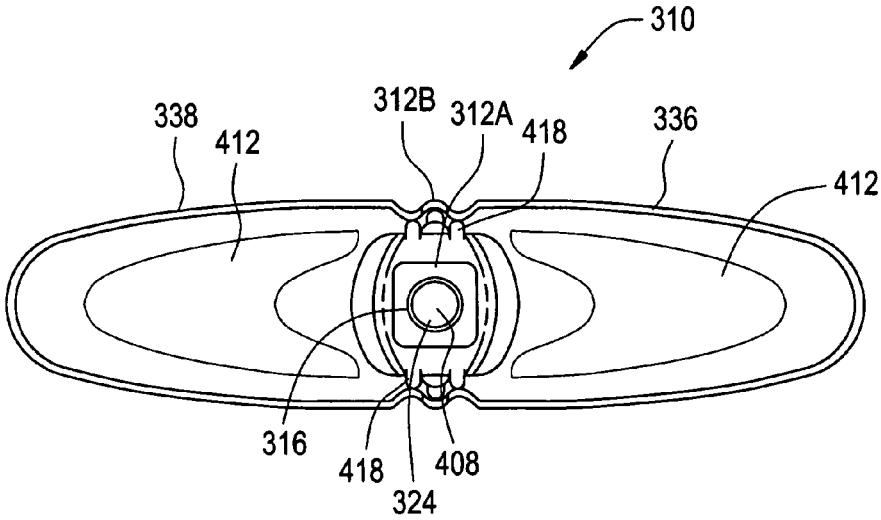
FIG. 28 is a front elevational view of the dispenser of FIG. 25 with both covers open.
Figure 29:
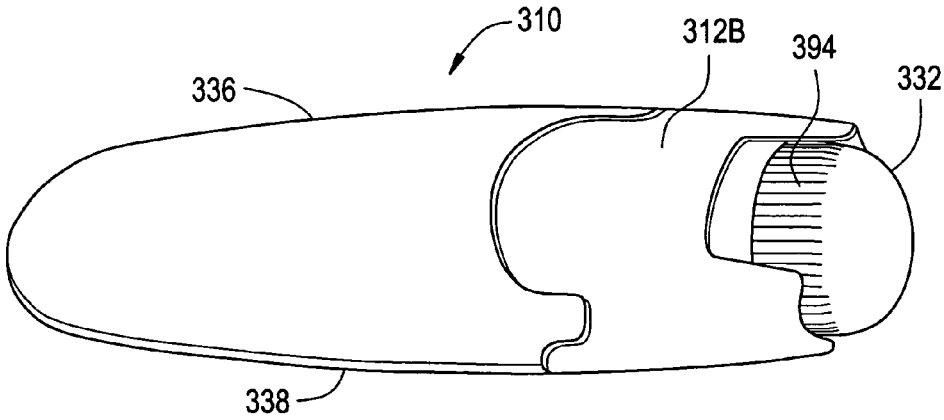
FIG. 29 is a side perspective view of the dispenser of FIG. 25 with both covers closed.
Figure 30:
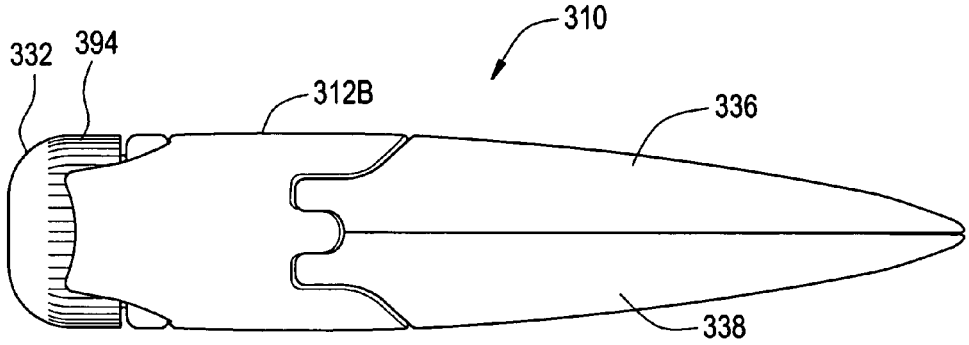
FIG. 30 is a side elevational view of the dispenser of FIG. 25 with both covers closed.
Figure 31:
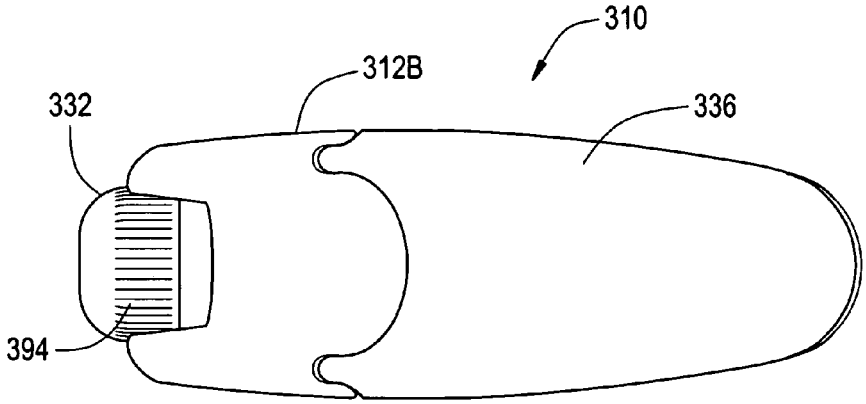
FIG. 31 is another side elevational view of the dispenser of FIG. 25 with both covers closed.
Figure 32:
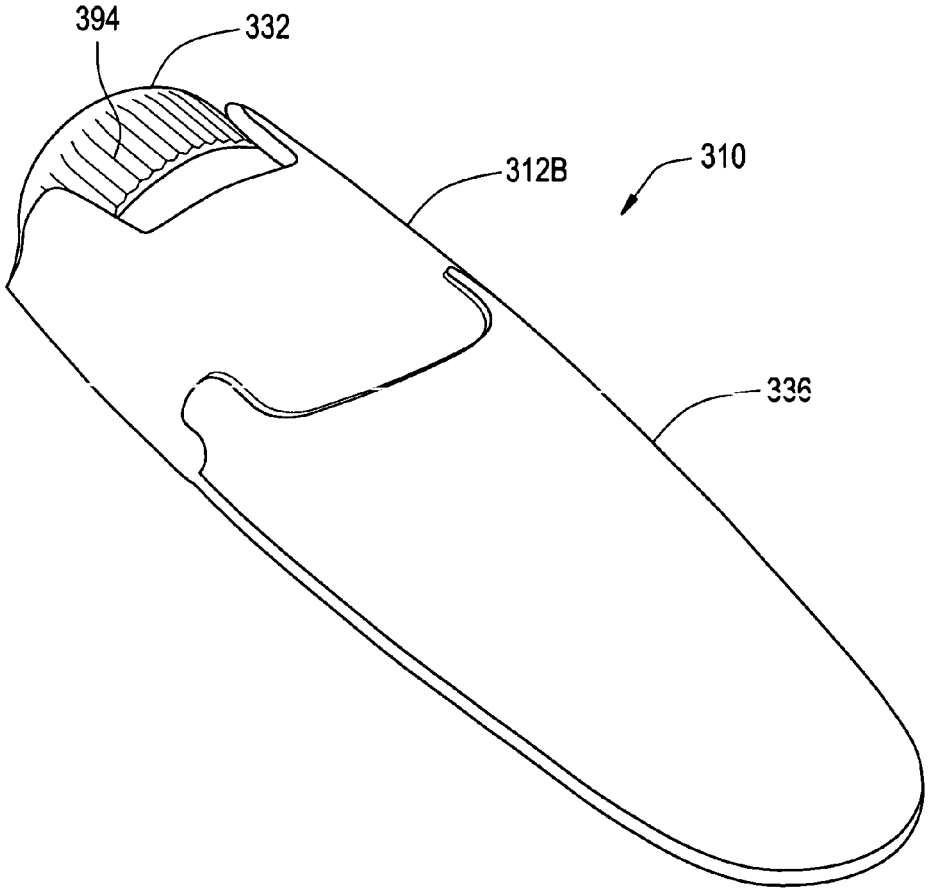
FIG. 32 is a top perspective view of the dispenser of FIG. 32 with both covers closed.

In the operation of the dispenser 310, a user may grasp the dispenser in one hand and flip open the covers 336, 338 as shown, for example, in FIG. 25. Then, the user may rotate the manually engageable portion 394 of the actuator 332 to dispense a metered dose of liquid lipstick, or other substance contained within the dispenser, through the dispensing nozzle 324 and onto the applicator surface 408. In order to apply the metered dosage of liquid lipstick or other substance contained within the dispenser to the lips (e.g., for lip applications, the dispenser may alternatively contain a lip balm or other substance that may be applied to a person's lips), the user may look into one or both mirrors 412, 412 to view the dispensing tip and/or lip surfaces and apply the applicator surface 408 containing the substance thereon to the lips. Upon contacting the desired lip surface with the applicator surface 408, the applicator surface contacts the lip surface and facilitates uniformly applying the substance in a film-like manner thereto. With the assistance of the mirror(s) 412, the user may then move the applicator surface 408 along the lip surface to uniformly spread the liquid lipstick or other substance thereon. As additional liquid lipstick or other substance is required to cover additional surface portions of the lips, the user may then rotate the manually-engageable portion 394 of the actuator 332 in the same manner as described above and repeat the application until the liquid lipstick or other substance is suitably applied. The applicator surface 408 defines a substantially convex surface contour, and therefore defines a different contour than the applicator surfaces described above. As may be recognized by those skilled in the pertinent art based on the teachings herein and in the above-mentioned co-pending patent applications, the applicator surfaces may take any of numerous different shapes or contours that are currently known, or that later become known.

Figure 33:
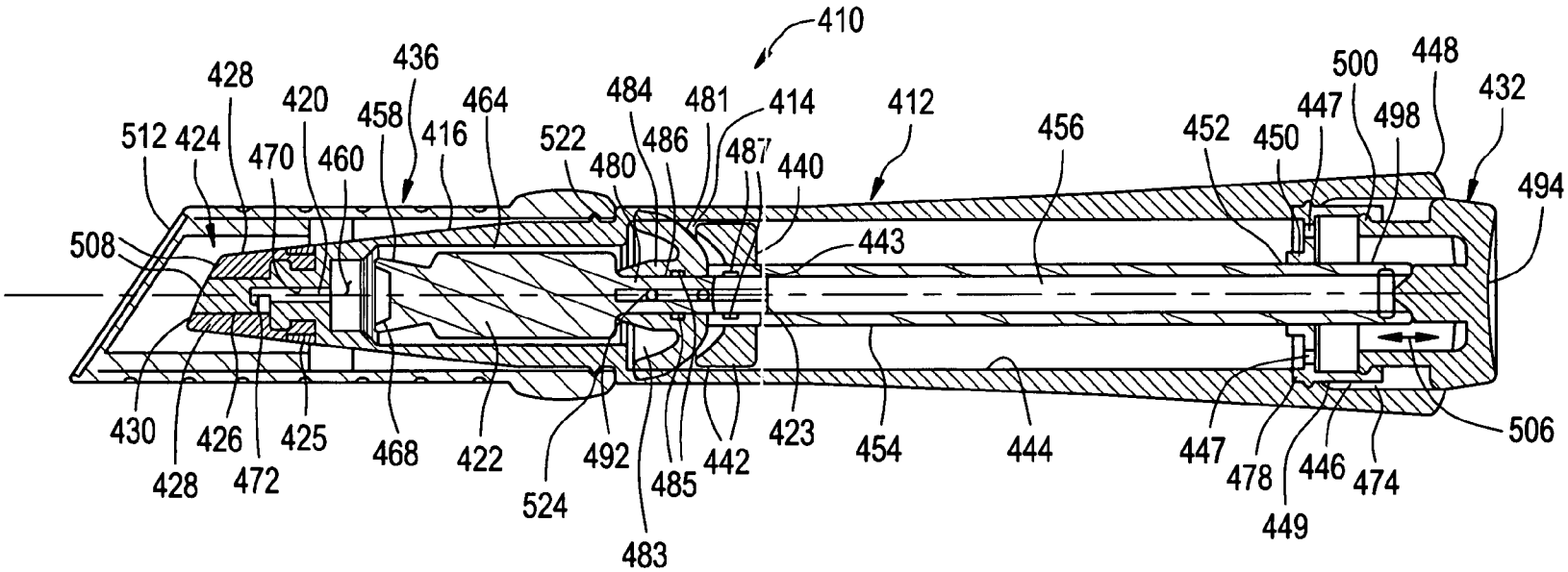
FIG. 33 is a cross-sectional view of another embodiment of a dispenser of the present invention including a plunger slidably mounted on the fill tube within the dispenser body and forming the variable-volume storage chamber, and a substantially dome-shaped spring formed integral with the filling valve cover for normally biasing the piston into the rest position.

In FIG. 33, another dispenser embodying the present invention is indicated generally by the reference numeral 410. The dispenser 410 is substantially similar to, for example, to the dispenser 110 described above, and therefore like reference numerals preceded by the numerals "4" and "5", instead of the numerals "1" and "2", respectively, are used to indicate like elements. A primary difference of the dispenser 410 in comparison to the dispenser 110, is that the dispenser 410 does not include a flexible inner bladder defining the variable-volume storage chamber 414. Rather, the dispenser 410 includes an annular piston or plunger 440 that extends between the body 412 and the inner fill tube 454. The plunger 440 includes at least one, and preferably two axially spaced, outer annular sealing members or portions 442 that sealingly engage the inner wall 444 of the body 412 to form a fluid-tight seal therebetween. The plunger 440 further includes at least one inner annular sealing member or portion 443 that sealingly engages the outer wall of the fill tube 454 and forms a fluid-tight seal therebetween. The sealing members or portions 442 and 443 may be formed integral with the plunger, such as by forming thereon annular protuberances, as shown, or may be formed by sealing members, such as O-rings or other sealing members, that are received within corresponding grooves or recesses formed in the plunger. As the piston 422 is progressively actuated, the plunger 440 slides forwardly within the dispenser (or in the direction of right to left in FIG. 33) due to the suction forces exerted thereon as the fluid or other substance is dispensed from the variable-volume storage chamber 414. The cap 446 defines a plurality of apertures 447 formed through the base wall thereof to allow the flow of air therethrough and, in turn, permit the plunger to slide inwardly upon dispensing the fluid or other substance from the variable-volume chamber 414.

In the illustrated embodiment, the plunger 440 is made of a relatively resilient plastic material, such as one of the plastics sold under the trademark Santoprene™ (e.g., Santoprene 8211-35 (shore 35 hardness) or 8211-55 (shore 55 hardness)). In addition, the valve cover 428 and dome spring 481 also are made of a relatively resilient plastic, such as one of the plastics sold under the trademark Santoprene™ (e.g., Santoprene 8211-35 (shore 35 hardness)). As may be recognized by those of ordinary skill in the pertinent art based on the teachings herein, these materials are only exemplary, and may be changed as desired or otherwise required by a particular application. For example, in applications requiring low sorption, the plunger and dispenser body may be formed of a relatively low sorptive material, such as a relatively hard plastic, including one or more of the plastics sold under the trademark Topaz.

An annular, tapered gap 449 is formed between the cap 446 and adjacent wall of the body 412 to facilitate inserting the cap into the body and snapping or otherwise fixedly securing the lobe 478 of the cap into the corresponding annular groove of the body. In this embodiment, the fill tube 454 is captured between the biasing force of the dome spring 481 and the actuator 432, and therefore there is no need to fixedly secure the actuator to the fill tube.

Another difference of the dispenser 410 in comparison to the dispenser 110 described above, is that the dome spring 481 is formed integral with the valve cover 484, but not with a corresponding bladder. Rather, the dispenser 410 includes the plunger 440 for forming the variable-volume storage chamber 414 in lieu of the flexible bladder described above. As can be seen, when the piston 454 is depressed inwardly to dispense a metered dose, the dome spring 481 deforms both axially and radially inwardly. Then, when the piston (or actuator) is released, the resiliency of the dome spring 481 drives the piston outwardly and into the rest position, as shown typically in FIG. 33. Although not shown, the base of the dome spring 481 defines a plurality of grooves or like flow passages formed between the dome spring and interior wall 444 of the body to allow the fluid or other substance in the variable-volume storage chamber 414 to flow therethrough and into the compression chamber 460.

Also in this embodiment, the piston 422 is formed separately from the fill tube 454 and is then fixedly secured to the fill tube. The piston 422 defines an axially-extending shaft 423 that is received within the inner end of the fill tube 454 to form the piston/fill tube assembly. The piston shaft 423 defines one or more first annular or other protuberances 485 received within corresponding annular or other grooves or recesses formed in the dome spring 481 to fixedly secure the dome spring to the piston, and one or more second annular or other protuberances 487 received within corresponding annular or other grooves or recesses formed in the fill tube 454 to fixedly secure the piston to the fill tube.

The valve assembly 424 of the dispenser 410 further includes a tamper-resistant ring 425 received within a corresponding annular groove formed in the base of the visco-elastic valve cover 428 to fixedly secure the valve cover to the valve seat. One advantage of the tamper-resistant ring 425 is that it prevents anyone from removing the valve cover and tampering with the contents of the dispenser without damaging the tamper-resistant ring.

As can be seen, the dispenser 410 defines a more narrow and elongated configuration than the dispenser 110 described above. As may be recognized by those of ordinary skill in the pertinent art based on the teachings herein, the dispensers of the invention may take any of numerous different shapes, configurations and/or sizes.

Figure 34:
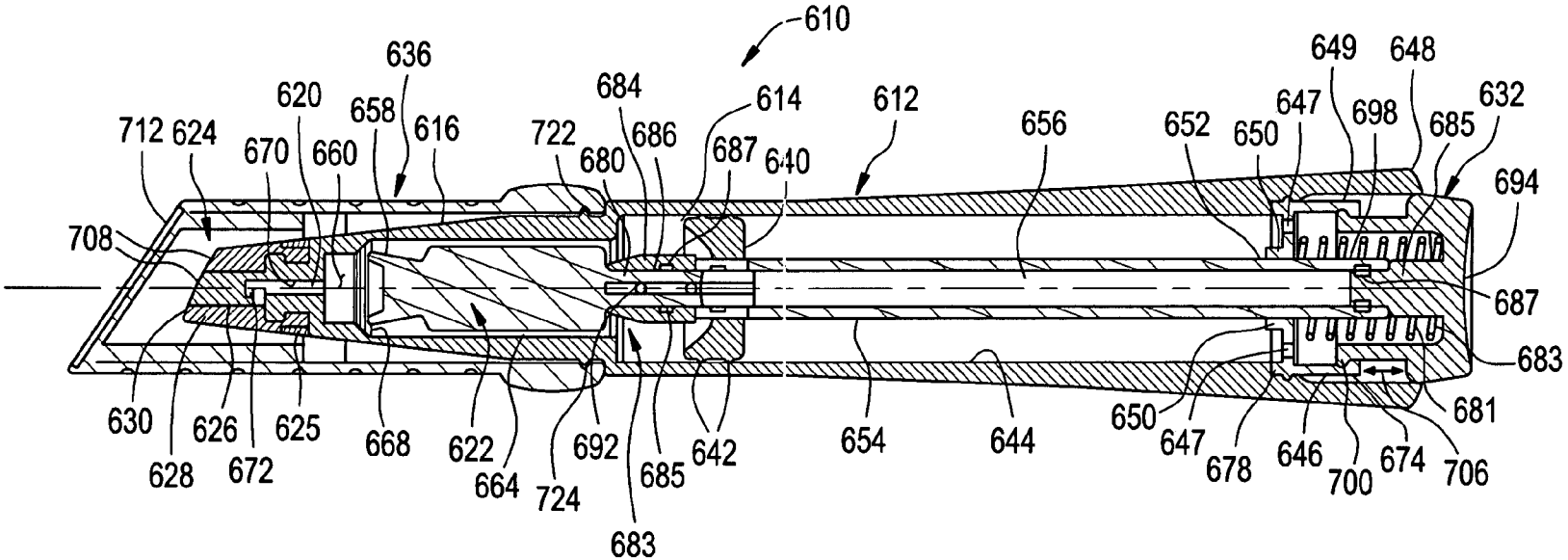
FIG. 34 is a cross-sectional view of another embodiment of a dispenser of the present invention including a plunger slidably mounted on the fill tube within the dispenser body and forming the variable-volume storage chamber, and a coil spring coupled between the manually-engageable actuator and end cap for normally biasing the piston into the rest position.

In FIG. 34, another dispenser embodying the present invention is indicated generally by the reference numeral 610. The dispenser 610 is substantially similar to, for example, to the dispenser 410 described above, and therefore like reference numerals preceded by the numerals "6" and "7", instead of the numerals "4" and "5", respectively, are used to indicate like elements. A primary difference of the dispenser 610 in comparison to the dispenser 410 described above, is that the dispenser 610 includes a coil spring 681 in lieu of the dome spring described above for biasing the piston into the rest position as shown. The coil spring 681 is received within an annular recess 683 formed within the actuator 632, and is seated between the base surface of the recess and the base surface of the end cap 646. Thus, to actuate the dispenser 610, the actuator 632 is depressed inwardly against the spring 681 to, in turn, compress the spring and drive the piston inwardly to dispense a metered dose. Then, when the actuator is released, the coil spring 681 expands and drives the piston 622 to return to its rest position as shown. In this embodiment, the actuator 632 defines a mounting post 685 that is received within the open end of the fill tube 654, and includes one or more protuberances 687 received within one or more recesses formed in the tube to fixedly secure the actuator to the tube.

As may be recognized by those of ordinary skill in the pertinent art based on the teachings herein, numerous changes and modifications may be made to the above-described and other embodiments of the present invention without departing from the spirit of the invention as defined in the claims. For example, the components of the dispensers may be made of any of numerous different materials that are currently or later become known for performing the function(s) of each such component. Similarly, the components of the dispensers may take any of numerous different shapes and/or configurations. Also, the dispensers may be used to dispense any of numerous different types of fluids or other substances for any of numerous different applications, including, for example, cosmetic, dermatological, or other pharmaceutical, cosmeceutical and/or OTC applications. Further, the filling machines used to fill the dispensers of the present invention may take any of numerous different configurations that are currently known, or that later become known for filling the dispensers. For example, the filling machines may have any of numerous different mechanisms for sterilizing, feeding, evacuating and/or filling the dispensers. Further, the filling valve need not be formed through the bladder or otherwise as shown, but may extend through the body or otherwise may be coupled in fluid communication with the storage chamber to evacuate and/or fill the storage chamber. Alternatively, the dispenser may include one valve for evacuating the interior of the dispenser and another valve for filling the storage chamber of the dispenser. Still further, the piston and/or dispensing valve each may take a configuration that is different than that disclosed herein. In another embodiment, the dispenser may include a needle penetrable and laser resealable stopper coupled in fluid communication with the variable-volume storage chamber for needle filling the storage chamber through the resealable stopper and then laser resealing the needle hole in the stopper as disclosed in the following patents and co-pending patent applications that are assigned to the Assignee of the present invention and are hereby expressly incorporated by reference as part of the present disclosure: U.S. Pat. No. 6,604,561, entitled "Medicament Vial Having a Heat-Sealable Cap, and Apparatus and Method for Filling the Vial"; U.S. Pat. No. 6,684,916, entitled "Medicament Vial Having a Heat-Sealable Cap, and Apparatus and Method for Filling the Vial"; U.S. patent application Ser. No. 10/694,364, filed Oct. 27, 2003, entitled "Medicament Vial Having a Heat-Sealable Cap, and Apparatus and Method for Filling the Vial"; U.S. patent application Ser. No. 10/766,172, filed Jan. 28, 2004, entitled "Medicament Vial Having a Heat-Sealable Cap, and Apparatus and Method for Filling the Vial"; and U.S. patent application Ser. No. 10/600,525, filed Jun. 19, 2003, entitled "Sterile Filling Machine Having Needle Filling within E-Beam Chamber". Accordingly, this detailed description of currently preferred embodiments is to be taken in an illustrative, as opposed to a limiting sense.

What is claimed is:

1. A dispenser for dispensing a substance, comprising:

a body;

a plunger slidably mounted within the body and forming a substantially fluid-tight seal therebetween, wherein the body and plunger define a variable-volume storage chamber for storing the substance;

a dispensing portion connected with the body and defining a compression chamber connectable in fluid communication with the storage chamber for receiving substance therefrom, and an outlet aperture coupled in fluid communication with the compression chamber;

a one-way valve including an axially-extending valve seat and an axially-extending flexible valve cover seated on the valve seat and defining a normally-closed, axially-extending seam therebetween forming a fluid-tight seal between the valve cover and valve seat, wherein the flexible valve cover is movable relative to the valve seat and the seam is connectable in fluid communication with the outlet aperture to allow the passage of a predetermined amount of substance through the seam and out of the dispenser; and a manually-engageable actuator movable relative to the compression chamber between a rest position and an actuated position, wherein (i) movement of the actuator in the direction from the rest position to the actuated position pressurizes a substantially predetermined amount of substance within the compression chamber and dispenses the substance through the outlet aperture and the axially-extending seam of the one-way valve, and (ii) movement of the actuator in the direction from the actuated position to the rest position draws a substantially predetermined amount of substance from the variable-volume storage chamber into the compression chamber, and moves the plunger within the body to reduce the volume of the storage chamber in an amount approximately equal to the volume of the substance dispensed, and including a spring biasing the manually-engageable actuator in the direction from the actuated position to the rest position.

2. A dispenser as defined in claim 1, wherein the flexible valve cover is responsive to a flow of substance in the outlet aperture exceeding a valve opening pressure to move between (i) a normally-closed closed condition, and (ii) an open condition wherein portions of the valve cover axially spaced relative to each other substantially sequentially move substantially radially relative to the valve seat to allow the passage of substance through the seam and out of the dispenser.

3. A dispenser for dispensing a cosmetic, comprising:

a body defining a variable-volume storage chamber for storing the cosmetic;

a dispensing portion connected with the body and including a compression chamber coupled in fluid communication wit the storage chamber for receiving cosmetic therefrom, an outlet aperture coupled in fluid communication with the compression chamber, and an applicator surface defining a contour substantially conforming to a facial contour for facilitating application of the cosmetic thereto;

a piston receivable within the compression chamber;

a one-way valve including an axially-extending valve seat and an axially-extending flexible valve cover seated on the valve seat and defining a normally-closed, axially-extending seam therebetween forming a fluid-tight seal between the valve cover and valve seat, wherein the flexible valve cover is movable relative to the valve seat and the seam is connectable in fluid communication with the outlet aperture to allow the passage of a predetermined amount of cosmetic through the seam and out of the dispenser; and an actuator drivingly connected to at least one of the piston and the compression chamber for moving at least one of the piston and the compression chamber relative to the other and dispensing a predetermined amount of cosmetic within the compression chamber through the outlet aperture.

4. A dispenser as defined in claim 3, further comprising a flexible bladder mounted within the body and defining the variable-volume storage chamber.

5. A dispenser as defined in claim 3, wherein the cosmetic is a liquid lipstick and the applicator surface defines a curvilinear contour.

6. A dispenser as defined in claim 5, wherein the applicator surface is defined by distal end portions of the valve cover and valve seat.

7. A dispenser for dispensing a substance, comprising:

a body;

a flexible bladder mounted within the body and defining a variable-volume storage chamber between the bladder and body for storing the substance;

a dispensing portion connected with the body and defining a compression chamber coupled in fluid communication with the storage chamber for receiving substance therefrom, and an outlet aperture coupled in fluid communication with the compression chamber;

a piston receivable within the compression chamber;

a one-way valve including an axially-extending valve seat and an axially-extending flexible valve cover seated on the valve seat and defining a normally-closed, axially-extending seam therebetween forming a fluid-tight seal between the valve cover and valve seat, wherein the flexible valve cover is movable relative to the valve seat and the scam is connectable in fluid communication with the outlet aperture to allow the passage of a predetermined amount of substance through the seam and out of the dispenser; and an actuator drivingly connected to at least one of the piston and the compression chamber for moving at least one of the piston and the compression chamber relative to the other and dispensing a predetermined amount of substance within the compression chamber through the outlet aperture.

8. A dispenser as defined in claim 7, wherein the bladder defines an axially extending, annular wall that is normally biased radially outwardly toward the body.

9. A dispenser as defined in claim 8, wherein the pressure within the storage chamber is greater than the ambient pressure external to the chamber.

10. A dispenser for dispensing a substance, comprising:

a body defining a variable-volume storage chamber for storing the substance;

a dispensing portion connected with the body and defining a compression chamber coupled in fluid communication with the storage chamber for receiving substance therefrom, and an outlet aperture coupled in fluid communication with the compression chamber;

a piston receivable within the compression chamber and biased axially away from the outlet aperture;

a one-way valve including an axially-extending valve seat and an axially-extending flexible valve cover seated on the valve seat and defining a normally-closed, axially-extending seam therebetween forming a fluid-tight seal between the valve cover and valve seat, wherein the flexible valve cover is movable relative to the valve seat and the seat is connectable in fluid communication with the outlet aperture to allow the passage of a predetermined amount of substance through the seam and out of the dispenser; and an actuator drivingly connected to at least one of the piston and the compression chamber for moving at least one of the piston and the compression chamber relative to the other and dispensing a predetermined amount of substance within the compression chamber through the outlet aperture.

11. A dispenser as defined in claim 10, further comprising a spring coupled to the piston and biasing the piston.

12. A dispenser as defined in claim 11, further comprising a flexible bladder mounted within the body and defining the storage chamber between the bladder and body, and wherein the spring is integral with the bladder.

13. A dispenser as defined in claim 11, wherein the spring is formed by a substantially dome-shaped elastomeric portion.

14. A dispenser as defined in claim 7, wherein the bladder defines a first axially-extending, annular surface, and the body defines a second axially-extending, annular surface facing the first surface of the bladder and forming the storage chamber therebetween, and wherein the first surface of the bladder is movable radially inwardly and away from the second surface of the body to expand the storage chamber and receive substance therein, and the first surface of the bladder is movable radially outwardly toward the second surface of the body upon dispensing substance therefrom.

15. A dispenser for dispensing a substance, comprising:

a body;

a flexible bladder mounted within the body and defining a storage chamber between the bladder and body for storing the substance;

a dispensing portion connected with the body and defining a compression chamber coupled in fluid communication with the storage chamber for receiving substance therefrom, and an outlet aperture coupled in fluid communication with the compression chamber;

a piston receivable within the compression chamber;

a one-way valve including an axially-extending valve seat and an axially-extending flexible valve cover seated on the valve seat and defining a normally-closed, axially-extending seam therebetween forming a fluid-tight seal between the valve cover and valve seat, wherein the flexible valve cover is movable relative to the valve seat and the seam is connectable in fluid communication with the outlet aperture to allow the passage of a predetermined amount of substance through the seam and out of the dispenser; and a cap coupled to the body and defining an aperture therethrough, wherein the piston is received through the aperture and at least one of the piston and cap is movable relative to the other between a first position with the piston spaced away from the outlet aperture and defining the compression chamber therebetween, and a second position with the piston located adjacent to the outlet aperture for dispensing a predetermined amount of substance within the compression chamber through the outlet aperture.

16. A dispenser as defined in claim 15, further comprising a manually engageable portion drivingly connected with the piston for moving the piston between the first and second positions.

17. A dispenser as defined in claim 16, wherein the manually engageable portion is axially depressible to move the piston between the first and second positions and dispense a predetermined amount of substance through the outlet aperture.

18. A dispenser for dispensing a substance, comprising:

a body defining a variable-volume storage chamber for storing the substance;

a dispensing portion connected with the body and defining a compression chamber coupled in fluid communication with the storage chamber for receiving substance therefrom, and an outlet aperture coupled in fluid communication with the compression chamber;

a piston slidably engageable with an annular surface of the compression chamber for forming a fluid-tight seal therebetween to, in turn, pressurize substance within the compression chamber and dispense pressurized substance through the outlet aperture, wherein at least one of the piston and compression chamber is movable relative to the other between a first position with the piston spaced away from the outlet aperture and the compression chamber located therebetween, and a second position with the piston located adjacent to the outlet aperture for dispensing a predetermined amount of substance within the compression chamber through the outlet aperture, and wherein (i) in the first position, the piston is located outside of the compression chamber and the compression chamber is coupled in fluid communication with the storage chamber, and (ii) in the second position, the piston is located within the compression chamber and the compression chamber is not coupled in fluid communication with the storage chamber;

a one-way valve including an axially-extending valve seat and an axially-extending flexible valve cover seated on the valve seat and defining a normally-closed, axially-extending seam therebetween forming a fluid-tight seal between the valve cover and valve seat, wherein the flexible valve cover is movable relative to the valve seat and the seam is connectable in fluid communication with the outlet aperture to allow the passage of a predetermined amount of substance through the seam and out of the dispenser; and an actuator drivingly connected to at least one of the piston and the compression chamber for moving at least one of the piston and the compression chamber relative to the other and dispensing a predetermined amount of substance within the compression chamber through the outlet aperture.

19. A dispenser as defined in claim 18, wherein the bore defines a first radial dimension within the compression chamber that is substantially equal to or less than a radial dimension of the piston for forming a fluid-tight seal therebetween, and the bore defines a second radial dimension greater than the first radial dimension on the opposite side of the compression chamber relative to the outlet aperture that forms a gap between the piston and bore with the piston located in the first position to allow the flow of substance therebetween.

20. A dispenser as defined in claim 1, further comprising at least one cover extending adjacent to and covering the dispensing portion and movably mounted with respect to the dispensing portion between a closed position covering the dispensing portion and an open position exposing the dispensing portion.

21. A dispenser as defined in claim 20, wherein the dispensing portion extends axially outwardly of the body, and the at least one cover is pivotally mounted to the body and extends axially outwardly of the body and adjacent to the dispensing portion.

22. A dispenser for dispensing a substance, comprising:

a body;

a plunger slidably mounted within the body and forming a substantially fluid-tight seal therebetween, wherein the body and plunger define a variable-volume storage chamber for storing the substance;

a dispensing portion connected with the body and extending axially outwardly of the body, the dispensing portion defining a compression chamber connectable in fluid communication with the storage chamber for receiving substance therefrom, and an outlet aperture coupled in fluid communication with the compression chamber;

a one-way valve including an axially-extending valve seat and an axially-extending flexible valve cover seated on the valve seat and defining a normally-closed, axially-extending seam therebetween forming a fluid-tight seal between the valve cover and valve seat, wherein the flexible valve cover is movable relative to the valve seat and the seam is connectable in fluid communication with the outlet aperture to allow the passage of a predetermined amount of substance through the seam and out of the dispenser;

a manually-engageable actuator movable relative to the compression chamber between a rest position and an actuated position, wherein (i) movement of the actuator in the direction from the rest position to the actuated position pressurizes a substantially predetermined amount of substance within the compression chamber and dispenses the substance through the outlet aperture and the axially-extending seam of the one-way valve, and (ii) movement of the actuator in the direction from the actuated position to the rest position draws a substantially predetermined amount of substance from the variable-volume storage chamber into the compression chamber, and moves the plunger within the body to reduce the volume of the storage chamber in an amount approximately equal to the volume of the substance dispensed, and including a spring biasing the manually-engageable actuator in the direction from the actuated position to the rest position; and first and second covers extending adjacent to and covering the dispensing portion and movably mounted with respect to the dispensing portion, wherein each cover extends axially outwardly of the body and is pivotally mounted to an opposite side of the body relative to the other and is movable between a closed position covering a respective side of the dispensing portion and an open position exposing the respective side of the dispensing portion.

23. A dispenser for dispensing a substance, comprising:

a body;

a plunger slidably mounted within the body and forming a substantially fluid-tight seal therebetween, wherein the body and plunger define a variable-volume storage chamber for storing the substance;

a dispensing portion connected with the body and defining a compression chamber connectable in fluid communication with the storage chamber for receiving substance therefrom, and an outlet aperture coupled in fluid communication with the compression chamber;

a one-way valve including an axially-extending valve seat and an axially-extending flexible valve cover seated on the valve seat and defining a normally-closed, axially-extending seam therebetween forming a fluid-tight seal between the valve cover and valve seat, wherein the flexible valve cover is movable relative to the valve seat and the seam is connectable in fluid communication with the outlet aperture to allow the passage of a predetermined amount of substance through the seam and out of the dispenser;

a manually-engageable actuator movable relative to the compression chamber between a rest position and an actuated position, wherein (i) movement of the actuator in the direction from the rest position to the actuated position vressurizes a substantially predetermined amount of substance within the compression chamber and dispenses the substance through the outlet aperture and the axially-extending seam of the one-way valve, and (ii) movement of the actuator in the direction from the actuated position to the rest position draws a substantially predetermined amount of substance from the variable-volume storage chamber into the compression chamber, and moves the plunger within the body to reduce the volume of the storage chamber in an amount approximately equal to the volume of the substance dispensed, and including a spring biasing the manually-engageable actuator in the direction from the actuated position to the rest position; and at least one cover extending adjacent to and covering the dispensing portion and movably mounted with respect to the dispensing portion between a closed position covering the dispensing portion and an oven Position exposing the dispensing portion, wherein the cover defines a reflective surface on an interior side thereof that is positionable to reflect a visible image of at least a portion of the dispensing portion thereon.

24. A dispenser as defined in claim 23, wherein the reflective surface is defined by a mirror.

25. A dispenser as defined in claim 23, comprising first and second covers, wherein each cover is pivotally mounted to the body and located on an opposite side of the body relative to the other, and movable between a closed position covering a respective side of the dispensing portion and an open position exposing the respective side of the dispensing portion, and wherein each cover includes a mirror on an interior side thereof.

26. A dispenser as defined in claim 1, wherein the outlet aperture extends substantially axially between the bore and the seam.

27. A dispenser for dispensing a substance, comprising:

a body;

a plunger slidably mounted within the body and forming a substantially fluid-tight seal therebetween, wherein the body and plunger define a variable-volume storage chamber for storing the substance;

a dispensing portion connected with the body and defining a compression chamber connectable in fluid communication with the storage chamber for receiving substance therefrom, and an outlet aperture coupled in fluid communication with the compression chamber and extending substantially axially between the bore and the seam, wherein the outlet aperture includes a first portion extending substantially axially adjacent to the bore, and a second portion extending substantially radially between the first portion and the seams;

a one-way valve including an axially-extending valve seat and an axially-extending flexible valve cover seated on the valve seat and defining a normally-closed, axially-extending seam therebetween forming a fluid-tight seal between the valve cover and valve seat, wherein the flexible valve cover is movable relative to the valve seat and the seam is connectable in fluid communication with the outlet aperture to allow the passage of a predetermined amount of substance through the seam and out of the dispenser; and a manually-engageable actuator movable relative to the compression chamber between a rest position and an actuated position, wherein (i) movement of the actuator in the direction from the rest position to the actuated position pressurizes a substantially predetermined amount of substance within the compression chamber and dispenses the substance through the outlet aperture and the axially-extending seam of the one-way valve, and (ii) movement of the actuator in the direction from the actuated position to the rest position draws a substantially predetermined amount of substance from the variable-volume storage chamber into the compression chamber, and moves the plunger within the body to reduce the volume of the storage chamber in an amount approximately equal to the volume of the substance dispensed, and including a spring biasing the manually-engageable actuator in the direction from the actuated position to the rest position.

28. A dispenser for dispensing a substance, comprising:

a body defining a variable-volume storage chamber for storing the substance;

a dispensing portion connected with the body and defining a compression chamber coupled in fluid communication with the storage chamber for receiving substance therefrom, and an outlet aperture coupled in fluid communication with the compression chamber;

a piston receivable within the compression chamber, wherein at least one of the piston and the body defines at least one drive surface, and the other defines at least one recessed surface for receiving therein the at least one drive surface for effecting step-wise axial movement of at least one of the piston and body relative to the other;

a one-way valve including an axially-extending valve seat and an axially-extending flexible valve cover seated on the valve seat and defining a normally-closed, axially-extending seam therebetween forming a, fluid-tight seal between the valve cover and valve seat, wherein the flexible valve cover is movable relative to the valve seat and the seam is connectable in fluid communication with the outlet aperture to allow the passage of a predetermined amount of substance through the seam and out of the dispenser; and an actuator drivingly connected to at least one of the piston and the compression chamber for moving at least one of the piston and the compression chamber relative to the other and dispensing a predetermined amount of substance within the compression chamber through the outlet aperture.

29. A dispenser as defined in claim 28, wherein the at least one drive surface is defined by at least one first thread, and the at least one recessed surface is defined by at least one second thread.

30. A dispenser as defined in claim 29, wherein the at least one first thread includes a plurality of axially-extending first tread portions, and the at least one second thread includes a plurality of axially-extending second tread portions.

31. A dispenser as defined in claim 30, wherein at least one of the first thread portions defines a diameter greater than a diameter of at least one second thread portion to effect step-wise movement of at least one of the piston and body relative to the other.

32. A dispenser as defined in claim 29, wherein each of the first and second threads defines a predetermined pitch set to dispense a predetermined volume of substance through the dispensing tip with each incremental movement of at least one of the piston and body relative to the other.

33. A dispenser as defined in claim 29, wherein the first thread is located on the piston and the second thread is located on the body, and a diameter of the first thread is greater than a diameter of the second thread to laterally expand the body upon threadedly engaging the first and second threads.

34. A dispenser as defined in claim 29, wherein the first thread is located on the piston and the second thread is located on the body, and the body defines a plurality of axially extending second thread portions and a plurality of axially-extending slots formed between second thread portions.

35. A dispenser for dispensing a substance, comprising:

a body defining a variable-volume storage chamber for storing the substance;

a dispensing portion connected with the body and defining a compression chamber coupled in fluid communication with the storage chamber for receiving substance therefrom, and an outlet aperture coupled in fluid communication with the compression chamber;

a piston receivable within the compression chamber;

a substantially annular second piston slidably received within the body and forming a substantially fluid-tight seal therebetween, wherein the variable-volume storage chamber is formed between the substantially annular second piston and the other piston, and the substantially annular second piston is movable toward the other piston upon dispensing a dosage from the storage chamber to reduce the volume of the storage chamber in an amount approximately equal to the volume of the dose dispensed;

a one-way valve including an axially-extending valve seat and an axially-extending flexible valve cover seated on the valve seat and defining a normally-closed, axially-extending seam therebetween forming a fluid-tight seal between the valve cover and valve seat, wherein the flexible valve cover is movable relative to the valve seat and the seam is connectable in fluid communication with the outlet aperture to allow the passage of a predetermined amount of substance through the seam and out of the dispenser; and an actuator drivingly connected to at least one of the piston and the compression chamber for moving at least one of the piston and the compression chamber relative to the other and dispensing a predetermined amount of substance within the compression chamber through the outlet aperture.

36. A dispenser for dispensing a substance, comprising:

a body defining a variable-volume storage chamber for storing the substance;

a dispensing portion connected with the body and defining a compression chamber coupled in fluid communication with the storage chamber for receiving substance therefrom, and an outlet aperture coupled in fluid communication with the compression chamber;

a piston receivable within the compression chamber;

a one-way valve including an axially-extending valve seat and an axially-extending flexible valve cover seated on the valve seat and defining a normally-closed, axially-extending seam therebetween forming a fluid-tight seal between the valve cover and valve seat, wherein the flexible valve cover is movable relative to the valve seat and the seam is connectable in fluid communication with the outlet aperture to allow the passage of a predetermined amount of substance through the seam and out of the dispenser;

a filling tube received within the body, and a second one-way valve coupled in fluid communication between the filling tube and the variable-volume storage chamber; and an actuator drivingly connected to at least one of the piston and the compression chamber for moving at least one of the piston and the compression chamber relative to the other and dispensing a predetermined amount of substance within the compression chamber through the outlet aperture.

37. A dispenser as defined in claim 36, wherein the second one-way valve includes an axially-extending valve seat and an axially-extending flexible valve cover seated on the valve seat and defining a normally-closed, axially-extending seam therebetween forming a fluid-tight seal between the valve cover and valve seat and the flexible valve cover is movable relative to the valve seat and the seam is connectable in fluid communication with variable-volume storage chamber to permit the passage of substance through the seat and into the storage chamber.

38. A dispenser as defined in claim 36, further comprising a substantially annular second piston slidably received between the body and filling tube and forming a substantially fluid-tight seal therebetween.

39. A dispenser as defined in claim 1, further comprising a filling valve coupled in fluid communication with the variable-volume storage chamber.

40. A dispenser for dispensing a substance, comprising:

a body forming a variable-volume chamber for storing the substance;

a dispensing portion defining a compression chamber coupled in fluid communication with the storage chamber for dispensing metered dosages of substance;

first means coupled in fluid communication between the storage chamber and compression chamber for pumping metered dosages of substance from the storage chamber through the compression chamber;

second means coupled in fluid communication with the dispensing portion (i) for normally sealing the dispensing portion along an annular, axially-extending seam and preventing the dispensing of substance below a threshold pressure through the dispensing portion, and (ii) for substantially sequentially opening the seam in an axial direction thereof to allow the passage of substance at a pressure greater than the threshold pressure through the dispensing portion and out of the dispenser;

third means for moving at least one of the compression chamber and first means relative to the other and dispensing a metered dosage of substance from the dispenser; and a piston including a substantially annular surface slidably received within the body and forming a substantially fluid-tight seal therebetween, wherein the variable-volume storage chamber is formed between the piston and the first means, and the piston is movable toward to first means upon dispensing a dosage from the storage chamber to reduce the volume of the storage chamber in an amount approximately equal to the volume of dose dispensed.

41. A dispenser as defined in claim 40, wherein the first means is a piston.

42. A dispenser as defined in claim 40, wherein the second means is a one-way valve including an axially-extending valve seat and an axially-extending flexible valve cover seated on the valve seat and defining a normally-closed, axially-extending seam therebetween forming a fluid-tight seal between the valve cover and valve seat.

43. A dispenser as defined in claim 40, further comprising fourth means for covering the dispensing portion and second means and movable relative thereto between a closed position covering the dispensing portion and second means and an open position exposing the dispensing portion and second means.

44. A dispenser as defined in claim 43, wherein the fourth means is a cover pivotally mounted on the body.

45. A dispenser for dispensing a substance, comprising:

a body portion;

a flexible biadder mounted within the body portion and defining a variable-volume storage chamber between the bladder and body portion for storing the substance;

first means coupled in fluid communication with the storage chamber for dispensing metered dosages of substance;

second means coupled in fluid communication between the storage chamber and first means for pumping metered dosages of substance from the storage chamber through the first means;

third means coupled in fluid communication with the storage chamber and first means (i) for normally sealing the first means along an annular, axially-extending seam and preventing the dispensing of substance below a threshold pressure through the first means, and (ii) for substantially sequentially opening the seam in an axial direction thereof to allow the passage of substance at a pressure greater than the threshold pressure through the first means and out of the dispenser; and fourth means for moving at least one of the first and second means relative to the other and dispensing a metered dosage of substance from the dispenser.

46. A dispenser as defined in claim 40, further comprising a filling tube received within the body, and a one-way valve coupled in fluid communication between the filling tube and the variable-volume storage chamber.

47. A dispenser for dispensing a substance, comprising:

first means for forming a variable-volume storage chamber for storing the substance;

a filling tube received within the first means, and a one-way valve coupled in fluid communication between the filling tube and the variable-volume storage chamber, wherein the one-way valve includes an axially-extending valve seat and an axially-extending flexible valve cover seated on the valve seat and defining a normally-closed, axially-extending seam therebetween forming a fluid-tight seal between the valve cover and valve seat, and the flexible valve cover is movable relative to the valve seat and the seam is connectable in fluid communication with variable-volume storage chamber to permit the passage of substance through the seam and into the storage chamber;

second means coupled in fluid communication with the storage chamber for dispensing metered dosages of substance;

third means coupled in fluid communication between the storage chamber and second means for pumping metered dosages of substance from the storage chamber through the second means;

fourth means coupled in fluid communication with the storage chamber and second means (i) for normally sealing the second means along an annular, axially-extending seam and preventing the dispensing of substance below a threshold pressure through the second means, and (ii) for substantially sequentially opening the seam in an axial direction thereof to allow the passage of substance at a pressure greater than the threshold pressure through the second means and out of the dispenser; and fifth means for moving at least one of the second and third means relative to the other and dispensing a metered dosage of substance from the dispenser.

48. A method for storing and dispensing a substance with a dispenser including a variable-volume storage chamber, a dispensing valve including an annular, axially-extending valve seat, and an annular, axially-extending flexible valve cover overlying the valve seat and forming an axially-extending valve seam therebetween, and a pump coupled in fluid communication between the variable-volume storage chamber and the valve seam, the method comprising the following steps:

storing substance in the variable-volume storage chamber;

normally sealing the dispensing valve along the annular, axially-extending valve seam and preventing both the dispensing of substance below a threshold pressure through the valve seam and external contamination of the substance in the variable-volume storage chamber through the valve seam;

manually actuating the pump to pressurize a metered dose of substance to a pressure greater than the threshold pressure and, in turn, substantially sequentially opening the valve seam in an axial direction thereof to allow the passage of substance at a pressure greater than the threshold pressure through the valve seam and out of the dispenser;

decreasing the volume of the variable-volume storage chamber in an amount approximately equal to the volume of the dosage of substance dispensed; and providing an inlet port and a second one-way valve mounted on the dispenser and coupled in fluid communication between the inlet port and variable-volume storage chamber, and including an axially-extending valve seat and an axially-extending flexible valve cover seated on the valve seat and defining a normally-closed, axially-extending seam therebetween forming a fluid-tight seal between the valve cover and valve seat, and further comprising the steps of inserting a filling member into the inlet port, pumping substance through the inlet port and into the seam of the second one-way valve at sufficient pressure to substantially radially move the flexible valve cover relative to the valve seat and, in turn, introduce the substance through the seam and into the variable-volume storage chamber, terminating pumping substance into the seam, allowing the valve cover to return to its normally-closed position, and hermetically sealing the substance within the variable-volume storage chamber.

49. A dispenser as defined in claim 1, wherein the spring is a substantially dome-shaped spring that normally biases the manually-engageable actuator into the rest position.

* * * * *